US010655890B2

(12) United States Patent
Hayden et al.

(10) Patent No.: US 10,655,890 B2
(45) Date of Patent: May 19, 2020

(54) TANKLESS ELECTRIC WATER HEATER

(71) Applicant: EEMAX, INC., Waterbury, CT (US)

(72) Inventors: Christopher Mark Hayden, Shelton, CT (US); Eric Robert Jurczyszak, Berlin, CT (US); Sergiu Gabriel Mihu, Newtown, CT (US); Richard Joseph Corcoran, North Kingstown, RI (US); Jens Bolleyer, Burlington, CT (US); Jeffrey Dean Hankins, Southbury, CT (US)

(73) Assignee: EEMAX, INC., Waterbury, CT (US)

( * ) Notice: Subject to any disclaimer, the term of this patent is extended or adjusted under 35 U.S.C. 154(b) by 390 days.

(21) Appl. No.: 15/614,204

(22) Filed: Jun. 5, 2017

(65) Prior Publication Data

US 2017/0268800 A1 Sep. 21, 2017

Related U.S. Application Data

(63) Continuation of application No. 14/973,223, filed on Dec. 17, 2015, now Pat. No. 9,702,585.
(Continued)

(51) Int. Cl.
*F24H 1/10* (2006.01)
*F24H 1/00* (2006.01)
*F24H 1/08* (2006.01)

(52) U.S. Cl.
CPC ..... *F24H 1/103* (2013.01); *F24H 1/0018* (2013.01); *F24H 1/08* (2013.01)

(58) Field of Classification Search
None
See application file for complete search history.

(56) References Cited

U.S. PATENT DOCUMENTS 270,478 A 1/1883 Pumphrey
601,585 A 3/1898 McElroy
(Continued)

FOREIGN PATENT DOCUMENTS

CN 201844531 5/2011
CN 102200346 A 9/2011
(Continued)

OTHER PUBLICATIONS

International Search Report dated Jun. 5, 2013 in PCT/US13/32298 filed Mar. 15, 2013.
(Continued)

*Primary Examiner* — Thor S Campbell
(74) *Attorney, Agent, or Firm* — Troutman Sanders LLP

(57) ABSTRACT

A tankless electric water heater system including a heating chamber having an inlet at a first end and an outlet at a second end, a heating element connected to the heating chamber, a first temperature sensor disposed near the first end of the heating chamber, a second temperature sensor disposed near the second end of the heating chamber, a flow sensor configured to detect a flow of water and disposed near the heating chamber, and a controller connected to the first and second temperature sensors, the flow sensor, and the heating element. The controller is configured to have a set point temperature, to detect temperature and flow data from the first and second temperature sensors, and the flow sensor, and to provide as output a power setting to the heating element.

19 Claims, 21 Drawing Sheets

Related U.S. Application Data

(60) Provisional application No. 62/093,181, filed on Dec. 17, 2014.

(56) References Cited

U.S. PATENT DOCUMENTS 1,718,970 A 7/1929 Lonergan
1,729,483 A 9/1929 Koch
1,777,744 A 10/1930 Breuer
1,821,525 A 9/1931 Nielsen
1,851,851 A 3/1932 Lee et al.
2,032,416 A 3/1936 Hunt
2,041,687 A 5/1936 Benson
2,224,422 A 12/1940 Ballman
2,360,019 A 10/1944 Ryan et al.
2,576,298 A 11/1951 Kessler
2,589,566 A 3/1952 Neth et al.
2,681,409 A 6/1954 Dobbins
2,730,609 A 1/1956 Constantinesco
2,824,199 A 2/1958 Browne
2,996,316 A 8/1961 Terhune
3,088,017 A 4/1963 Schomann
3,108,174 A 10/1963 Hynes
3,310,769 A 3/1967 Simmons
3,313,921 A 4/1967 Mohn et al.
3,329,455 A 7/1967 Becker et al.
3,512,114 A 5/1970 Dzaack
3,625,549 A 12/1971 De Vries
3,633,748 A 1/1972 Hanley et al.
3,921,505 A 11/1975 Wunsch
3,977,073 A 8/1976 Shirey
4,056,143 A 11/1977 Martin
4,142,515 A 3/1979 Skaats
4,185,187 A 1/1980 Rogers
4,242,775 A 1/1981 Eickmann
4,250,399 A 2/1981 King
4,270,367 A 6/1981 Santore
4,338,888 A 7/1982 Gerstmann et al.
4,439,669 A 3/1984 Ryffel
4,460,201 A 7/1984 McGugan
4,600,334 A 7/1986 Soussloff
4,682,578 A 7/1987 Schmidt
4,762,980 A 8/1988 Insley
4,775,258 A 10/1988 Lange
4,808,793 A 2/1989 Hurko
4,813,992 A 3/1989 Hale
4,835,365 A 5/1989 Etheridge
4,885,840 A 12/1989 McManus
4,892,432 A 1/1990 Cooper
5,054,108 A 10/1991 Gustin et al.
5,122,640 A 6/1992 Holmes
5,124,534 A 6/1992 Williams et al.
RE34,018 E 8/1992 Petersen et al.
5,216,743 A 6/1993 Seitz
5,243,185 A 9/1993 Blackwood
5,269,572 A 12/1993 Mefferd
5,293,446 A 3/1994 Owens et al.
5,308,207 A 5/1994 Jaskowiak
5,325,822 A 7/1994 Fernandez
5,384,032 A 1/1995 De Souza
5,400,432 A 3/1995 Kager et al.
5,408,575 A 4/1995 Bolivar
5,549,078 A 8/1996 Annecharico et al.
5,559,924 A 9/1996 Kadotani et al.
5,628,895 A 5/1997 Zucholl
5,740,315 A 4/1998 Onishi et al.
5,772,355 A 6/1998 Ross et al.
5,897,269 A 4/1999 Ross et al.
5,930,458 A 7/1999 Yane et al.
5,959,254 A 9/1999 Martin, Sr.
5,995,711 A 11/1999 Fukuoka et al.
6,005,225 A 12/1999 Kowalski et al.
6,020,577 A 2/2000 Barker
6,055,360 A 4/2000 Inoue et al.
6,091,890 A 7/2000 Gruzdev et al.
6,097,007 A 8/2000 Wang
6,157,778 A 12/2000 Kadotani
6,199,515 B1 3/2001 Clarke
6,231,194 B1 5/2001 Raj et al.
6,236,810 B1 5/2001 Kadotani
6,240,250 B1 5/2001 Blanco, Jr.
6,246,831 B1 6/2001 Seitz et al.
6,252,220 B1 6/2001 Jedlicka et al.
6,259,070 B1 7/2001 Audet
6,297,740 B1 10/2001 Hill et al.
6,345,769 B2 2/2002 MacIntyre
6,509,554 B2 1/2003 Howard et al.
6,593,553 B2 7/2003 Whitfield
6,909,843 B1 6/2005 Fabrizio
7,007,316 B2 3/2006 Lutz, II
7,039,305 B1 5/2006 Chen
7,046,922 B1 5/2006 Sturm et al.
7,156,425 B2 1/2007 Atkinson
7,190,894 B2 3/2007 Chamberlain, Jr.
7,293,914 B2 11/2007 Wang
7,324,746 B2 1/2008 Tanaka et al.
7,592,572 B2 9/2009 Schlipf
7,593,625 B2 9/2009 Kamikawa et al.
7,668,444 B2 2/2010 Tsai
7,744,008 B2 6/2010 Chapman, Jr. et al.
7,773,868 B2 * 8/2010 Moore ..... F24D 19/1051 122/14.3
7,857,002 B2 12/2010 Reck
7,972,077 B2 7/2011 Kim
8,104,434 B2 1/2012 Fabrizio
8,165,461 B2 4/2012 Sullivan
8,280,236 B2 10/2012 Fabrizio
8,304,699 B2 11/2012 Filess
8,380,056 B2 2/2013 Evans
8,426,779 B2 4/2013 Schlipf
8,577,211 B2 11/2013 Lucker et al.
9,140,466 B2 9/2015 Jurczyszak et al.
2002/0008970 A1 1/2002 Hanson et al.
2003/0026603 A1 2/2003 Castaneda et al.
2004/0041033 A1 * 3/2004 Kemp ..... G05D 23/1393 236/12.12
2004/0041034 A1 * 3/2004 Kemp ..... G05D 23/1393 236/12.12
2004/0051313 A1 3/2004 Trouyet
2004/0069517 A1 4/2004 Olson
2004/0098831 A1 5/2004 Elmer
2005/0072103 A1 4/2005 Hopwood
2006/0168756 A1 8/2006 Sato et al.
2006/0215178 A1 9/2006 Seko et al.
2006/0222349 A1 10/2006 Sturm et al.
2007/0017265 A1 1/2007 Andersson
2007/0023418 A1 2/2007 Schlipf
2008/0028512 A1 2/2008 Hughson
2008/0152331 A1 * 6/2008 Ryks ..... F24H 1/08 392/490
2008/0197205 A1 * 8/2008 Ene ..... F24H 1/43 237/19
2008/0274823 A1 11/2008 Lindner
2008/0285964 A1 11/2008 Sullivan
2009/0025399 A1 1/2009 Kamen et al.
2009/0034947 A1 2/2009 Tsai
2009/0116826 A1 5/2009 Evans
2010/0068123 A1 3/2010 Edwin et al.
2010/0086289 A1 4/2010 Johnson et al.
2010/0093205 A1 4/2010 Stone et al.
2010/0126108 A1 5/2010 Andrikopoulos
2010/0195991 A1 8/2010 Delvasigamani
2010/0212752 A1 8/2010 Fima
2010/0329650 A1 12/2010 Kim
2011/0048404 A1 * 3/2011 Lee ..... F24D 3/082 126/587
2011/0203781 A1 8/2011 Ellingwood et al.
2011/0233191 A1 9/2011 Gubler et al.
2011/0240269 A1 10/2011 Mackenzie
2011/0318090 A1 12/2011 Lai
2012/0055917 A1 3/2012 Kimmins et al.
2012/0063755 A1 3/2012 Lucker et al.
2012/0138149 A1 6/2012 Hatada
2012/0141100 A1 6/2012 Evans
2012/0237191 A1 9/2012 Clark

(56) References Cited

U.S. PATENT DOCUMENTS

| | | | | |
|---|---|---|---|---|
| 2012/0275775 | A1 | 11/2012 | Iskrenovic | |
| 2013/0034344 | A1 | 2/2013 | Lutz et al. | |
| 2013/0156492 | A1 | 6/2013 | Maier | |
| 2014/0023352 | A1 | 1/2014 | Jurczyszak et al. | |
| 2014/0023354 | A1 | 1/2014 | Hankins et al. | |
| 2015/0345826 | A1* | 12/2015 | Lutz, II | F24H 1/102 392/490 |
| 2016/0178234 | A1* | 6/2016 | Hayden | F24H 1/0018 392/486 |

FOREIGN PATENT DOCUMENTS

| | | | |
|---|---|---|---|
| DE | 197 26 288 | A1 | 6/1997 |
| EP | 2 573 642 | A2 | 3/2013 |
| JP | 11-148716 | | 6/1999 |
| WO | WO 98/31045 | A2 | 7/1998 |

OTHER PUBLICATIONS

International Written Opinion dated Jun. 5, 2013 in PCT/US13/32298 filed Mar. 15, 2013.

International Search Report dated Jan. 3, 2014, in PCT/US2013/050897, filed Jul. 17, 2013.

Written Opinion of the International Searching Authority dated Jan. 3, 2014, in PCT/US2013/050897, filed Jul. 17, 2013.

Office Action dated Apr. 24, 2015, in co-pending U.S. Appl. No. 13/943,495.

Combined Chinese Office Action and Search Report dated Sep. 25, 2015 in Patent Application No. 201380046720.5 (with English language translation).

* cited by examiner

TANKLESS ELECTRIC WATER HEATER

CROSS-REFERENCE TO RELATED APPLICATIONS

This application is a continuation application of U.S. application Ser. No. 14/973,223 filed Dec. 17, 2015, which is based on and claims priority to U.S. Provisional Patent Application No. 62/093,181, filed on Dec. 17, 2014, the entire contents of each are hereby incorporated by reference herein.

BACKGROUND

Water heating is a thermodynamic process that uses an energy source to heat water above its initial temperature. Typical domestic uses of hot water include cooking, cleaning, bathing, and space heating.

Water can be heated in vessels known as water heaters, tanks, kettles, cauldrons, pots, or coppers. A metal vessel that heats a batch of water does not produce a continual supply of heated water at a preset temperature. The water temperature varies based on the consumption rate, becoming cooler over time and as flow increases, and the vessel is depleted.

SUMMARY

The present disclosure is directed to a tankless electric water heater system. The tankless electric water heater has a heating chamber with an inlet at a first end and an outlet at a second end, a heating element connected to the heating chamber, a first temperature sensor disposed near the first end of the heating chamber, a second temperature sensor disposed near the second end of the heating chamber, a flow sensor configured to detect a flow of water and disposed near the heating chamber, and a controller connected to the first and second temperature sensors, the flow sensor, and the heating element. The controller is configured to have a set point temperature, to detect temperature and flow data from the first and second temperature sensors, and the flow sensor, and to provide as output a power setting to the heating element.

The foregoing general description of the illustrative implementations and the following detailed description thereof are merely exemplary aspects of the teachings of this disclosure, and are not restrictive.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings wherein.

DETAILED DESCRIPTION OF THE EMBODIMENTS

Figure 1A:
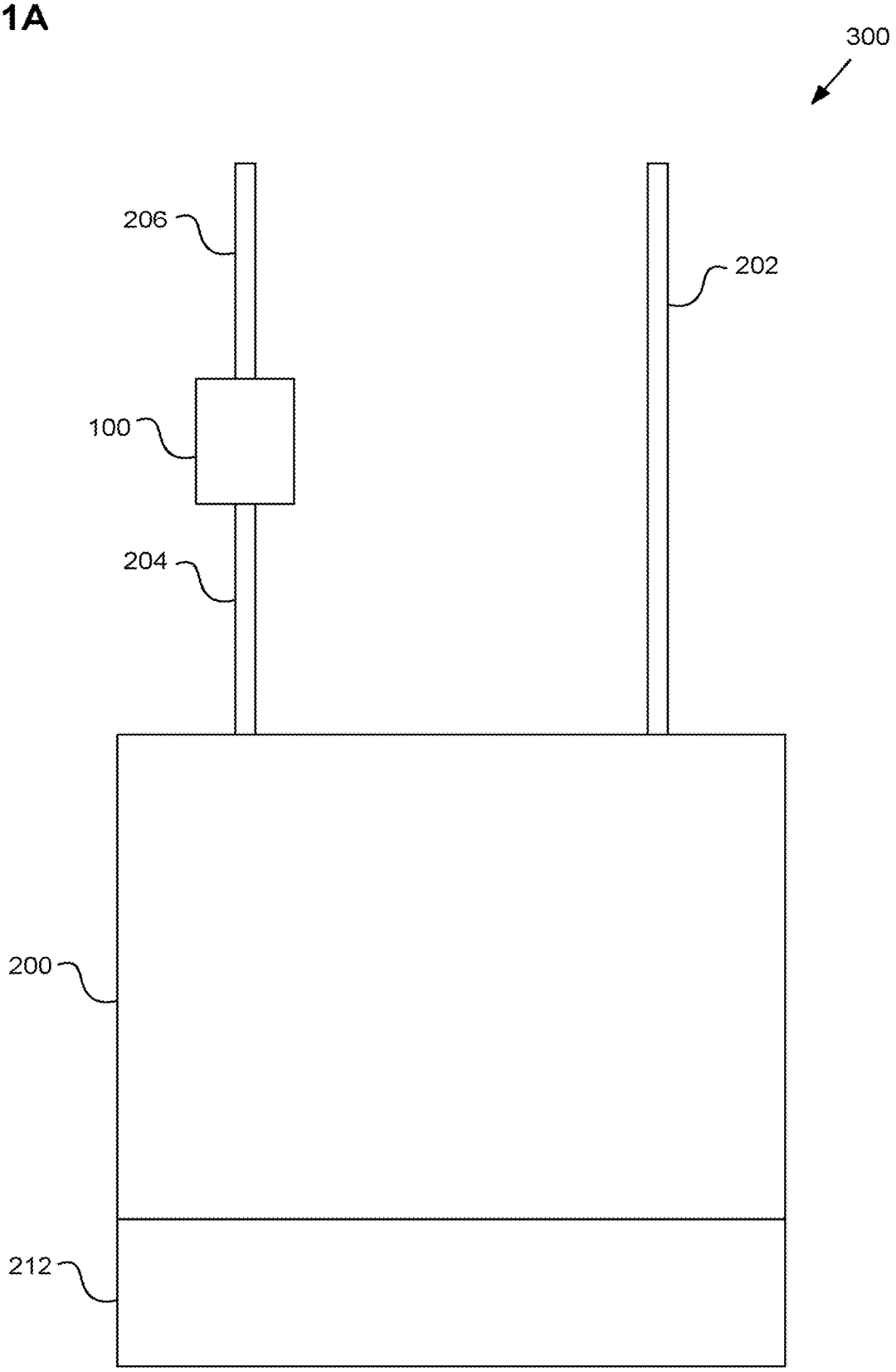
FIG. 1A is an overview diagram of a first liquid heating system, according to one example.

In the drawings, like reference numerals designate identical or corresponding parts throughout the several views. Further, as used herein, the words "a", "an" and the like generally carry a meaning of "one or more", unless stated otherwise.

Referring now to the drawings, wherein like reference numerals designate identical or corresponding parts throughout the several views.

FIG. 1A is an overview diagram of a first liquid heating system 300, according to one example. The liquid heating system 300 includes a tankless electric water heater 100 connected to a liquid storage device 200 by a first inlet pipe 204. The liquid storage device 200 is further connected to a second inlet pipe 202 that supplies water to the liquid storage device 200. The first inlet pipe 204 transports water from the liquid storage device 200 to the tankless electric water heater 100. The tankless electric water heater 100 is also connected to an outlet pipe 206 that transports water out of the tankless electric water heater 100 to another system or end user.

In one example, the liquid storage device 200 may be connected to a heat source 212 that provides heat to the liquid storage device 200 to heat water inside the liquid storage device 200. For example, the heat source 212 may derive energy from electricity, natural gas, or geothermal sources.

Further, various embodiments of the tankless electric water heater 100 can also be used in conjunction with pool and spa heating, aquariums, hydroponics, radiant, solar, recirculation, industrial processes, and other applications.

While the embodiments described herein are connected at the outlet of a liquid storage device 200, other embodiments of the tankless electric water heater 100 may also be connected at the inlet of, on, at, near, or in a liquid storage device 200 to heat and maintain fluid temperature ranges.

An advantageous feature of the tankless electric water heater 100 is the ability to immediately increase the effective volume of heated water available from the liquid storage device 200 equipped with the heat source 212 by heating at the tankless electric water heater 100 a flow of water as it flows out of the liquid storage device 200 rather than continuously heating only a quantity of water in a finite volume, such as that in the liquid storage device 200.

Another advantageous feature of the tankless electric water heater 100 is reduced energy consumption since heat energy is not needed to maintain an elevated water temperature prior to use, as is needed when heated water is stored in the liquid storage device 200 and not used immediately. Energy is wasted to maintain heated water on standby while the water gradually cools and dissipates the heat energy to the atmosphere. The volume of heated water that can be stored has limited utility when the supply of heated water needed during a period of high water consumption, for example in a case where multiple people shower or bath using the same hot water supply in a liquid storage device 200, exceeds an available volume.

Another advantage of the tankless electric water heater 100 is the ability to store water in a liquid storage device 200 at lower temperature, and only heating water as it flows out as needed. Maintaining a largely stagnant tank of water at an elevated temperature may introduce additional risk of growth of certain bacteria that can cause illness and disease in humans, such as Legionella. The bacteria is known to reside within a variety of soil and aquatic systems and has an ideal temperature growth range from about 90 degrees F. to about 108 degrees F., though its growth range begins at about 77 degrees F. Storing water at a cooler temperature and then heating the water as it leaves the liquid storage device 200 can reduce certain health risks.

Figure 1B:
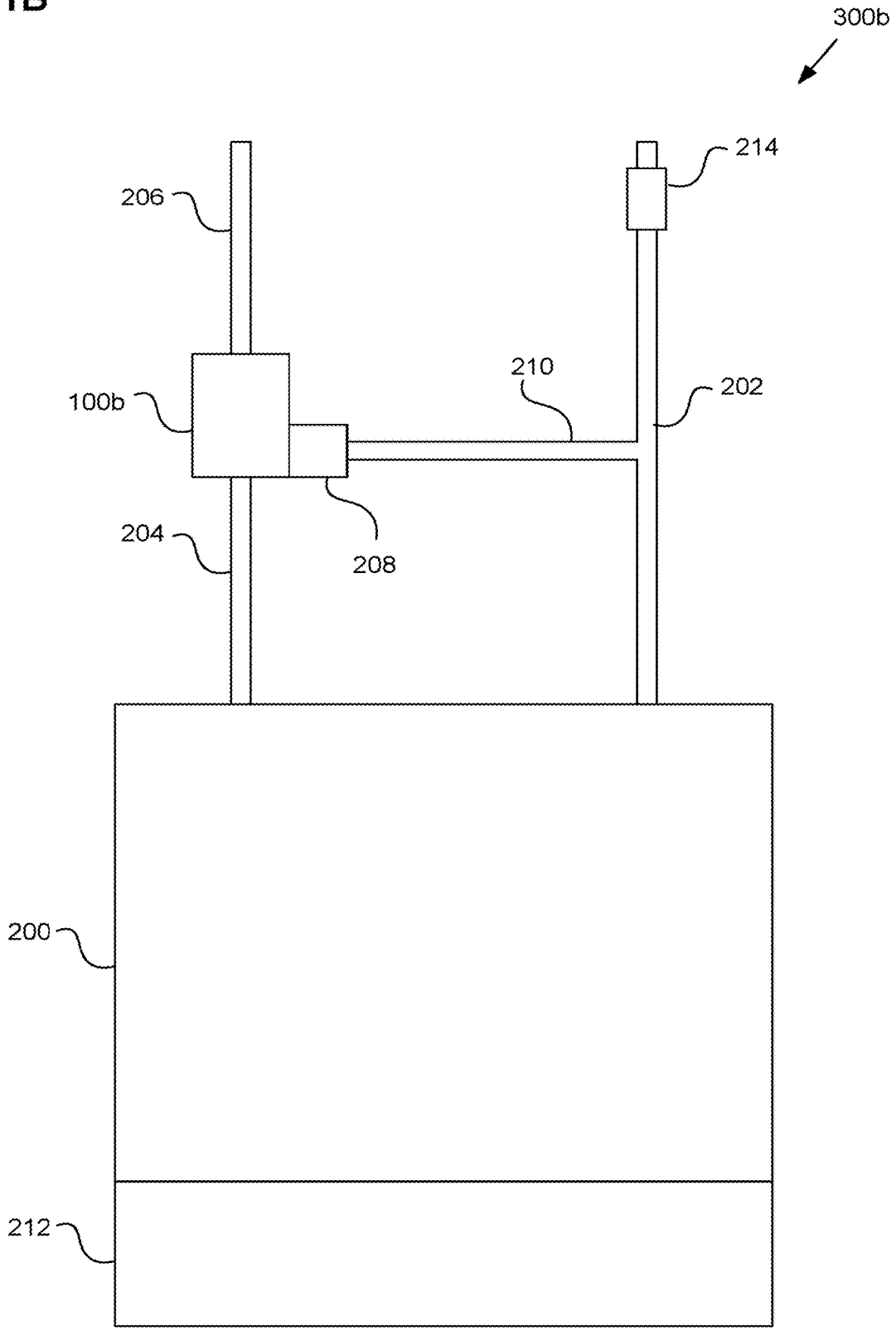
FIG. 1B is an overview diagram of a second liquid heating system, according to one example.

FIG. 1B is an overview diagram of a second liquid heating system 300*b*, according to one example. The liquid heating system 300*b* includes a tankless electric water heater 100*b* connected to the liquid storage device 200 by the first inlet pipe 204. The liquid storage device 200 is further connected to the second inlet pipe 202 that supplies water to the liquid storage device 200. The first inlet pipe 204 transports water from the liquid storage device 200 to the tankless electric water heater 100*b*, and the outlet pipe 206 transports water out of the tankless electric water heater 100*b*.

Further, the tankless electric water heater 100*b* is connected to a recirculation pump 208 and a recirculation pipe 210 at a point before a heating element 128 (further illustrated in at least FIGS. 2E and 3B) of the tankless electric water heater 100*b*. The recirculation pump 208 recirculates water from the tankless electric water heater 100*b* through the recirculation pipe 210 and the second inlet pipe 202, back toward the liquid storage device 200. An inlet proportioning valve 214 may be connected to the second inlet pipe 202 at a point upstream of the recirculation pipe 210, and a controller of the tankless electric water heater 100*b* may electrically control operation of the recirculation pump 208, and the opening and closing of the inlet proportioning valve 214 to recirculate water from the liquid storage device 200 back to the liquid storage device 200 to reduce the effect of stratification. The inlet proportioning valve 214 provides for mixing of heated and unheated water flowing into the liquid storage device 200, allowing for recirculation of only heated water, or inflow of only unheated water. In one example, the liquid storage device 200 may be connected to the heat source 212 that provides energy to the liquid storage device 200 to heat water inside the liquid storage device 200.

Hot water capacity in the liquid storage device 200, for example a tank, may be limited by stratification, a phenomenon that experimental results have shown can significantly reduce useful hot water capacity of the liquid storage device 200, further reducing energy efficiency.

A liquid storage device 200 without external flow is subject to an ambient temperature, and a thermal stratification of water is formed in the course of a cooling process. Cold water accumulates at the bottom while hot water ascends to the top of the liquid storage device 200. This phenomenon occurs even if all the water inside the liquid storage device 200 is initially at a uniform temperature.

This is because prior to releasing heat to the ambient surroundings, the liquid storage device 200 cools a thin, vertical layer of water along the inside nearest the external atmosphere. Part of this heat is then transferred by diffusion towards the center of the liquid storage device 200. The water of the thin vertical layer becomes denser than its surrounding and then slips towards the bottom of the liquid storage device 200, creating stratification. This can effectively reduce usable heated water in the liquid storage device 200.

An advantageous feature of this example of the tankless electric water heater 100*b* is reduced energy loss in the liquid storage device 200 from stratification. Recirculation of heated water from the tankless electric water heater 100 via the recirculation pump 208 results in a more even water temperature distribution inside the liquid storage device 200.

The tankless electric water heater 100*b* further allows the use of a smaller liquid storage device 200 to produce an equivalent amount of hot water as a larger liquid storage device 200, reducing the total amount of heat energy that is lost to the atmosphere to maintain hot water temperature.

In another example, the recirculation pump 208 is connected to the first inlet pipe 204 entirely upstream of the tankless electric water heater 100*b*, and the recirculation pipe 210 connects the outlet of the recirculation pump 208 to the second inlet pipe 202.

Figure 1C:
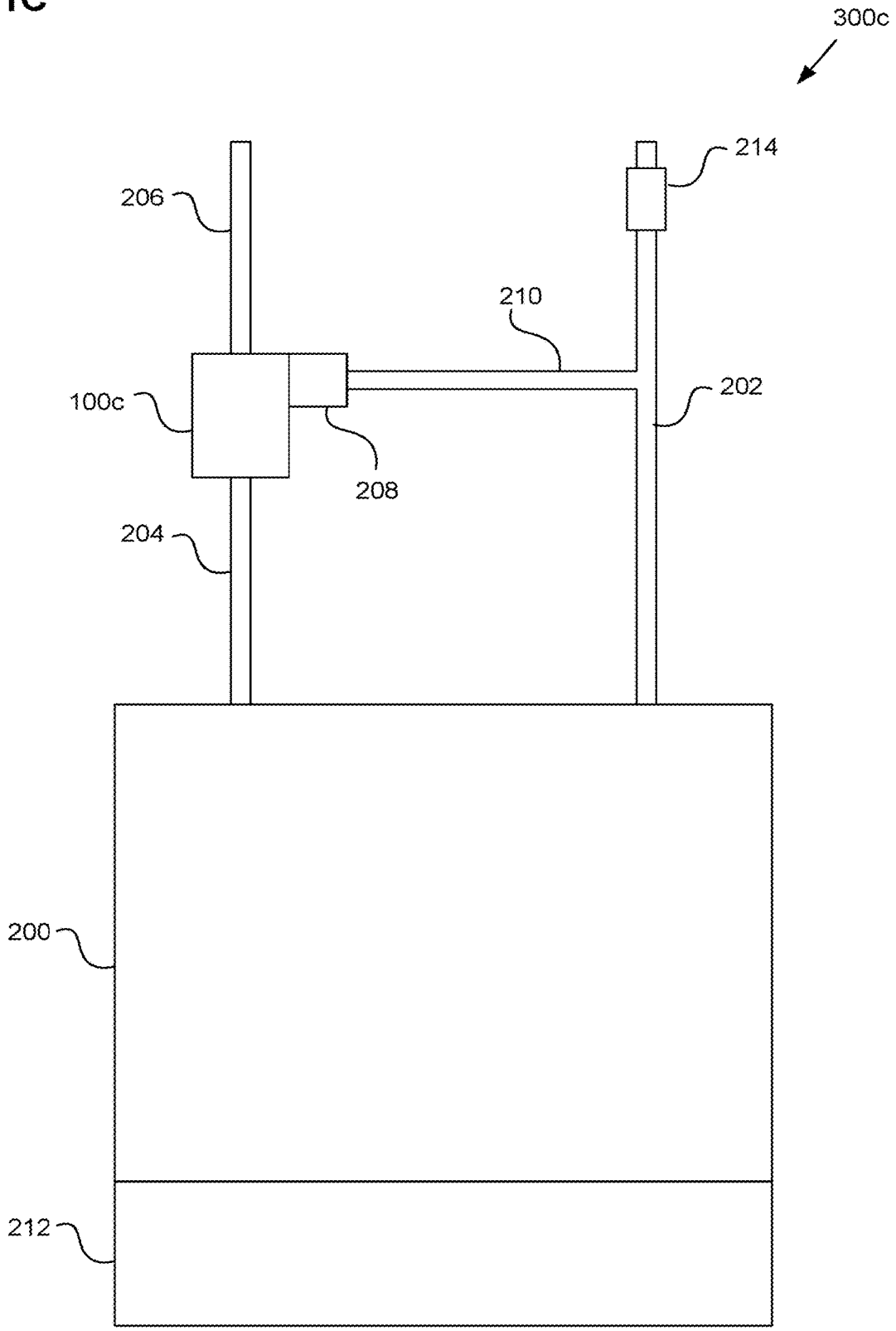
FIG. 1C is an overview diagram of a third liquid heating system, according to one example.

FIG. 1C is an overview diagram of a third liquid heating system 300*c*, according to one example. The liquid heating system 300*c* includes a tankless electric water heater 100*c* connected to the liquid storage device 200 by the first inlet pipe 204. The liquid storage device 200 is further connected to the second inlet pipe 202 that supplies water to the liquid storage device 200. The first inlet pipe 204 transports water from the liquid storage device 200 to the tankless electric water heater 100*c*, and an outlet pipe 206 transports water out of the tankless electric water heater 100*c*.

Figure 3A:
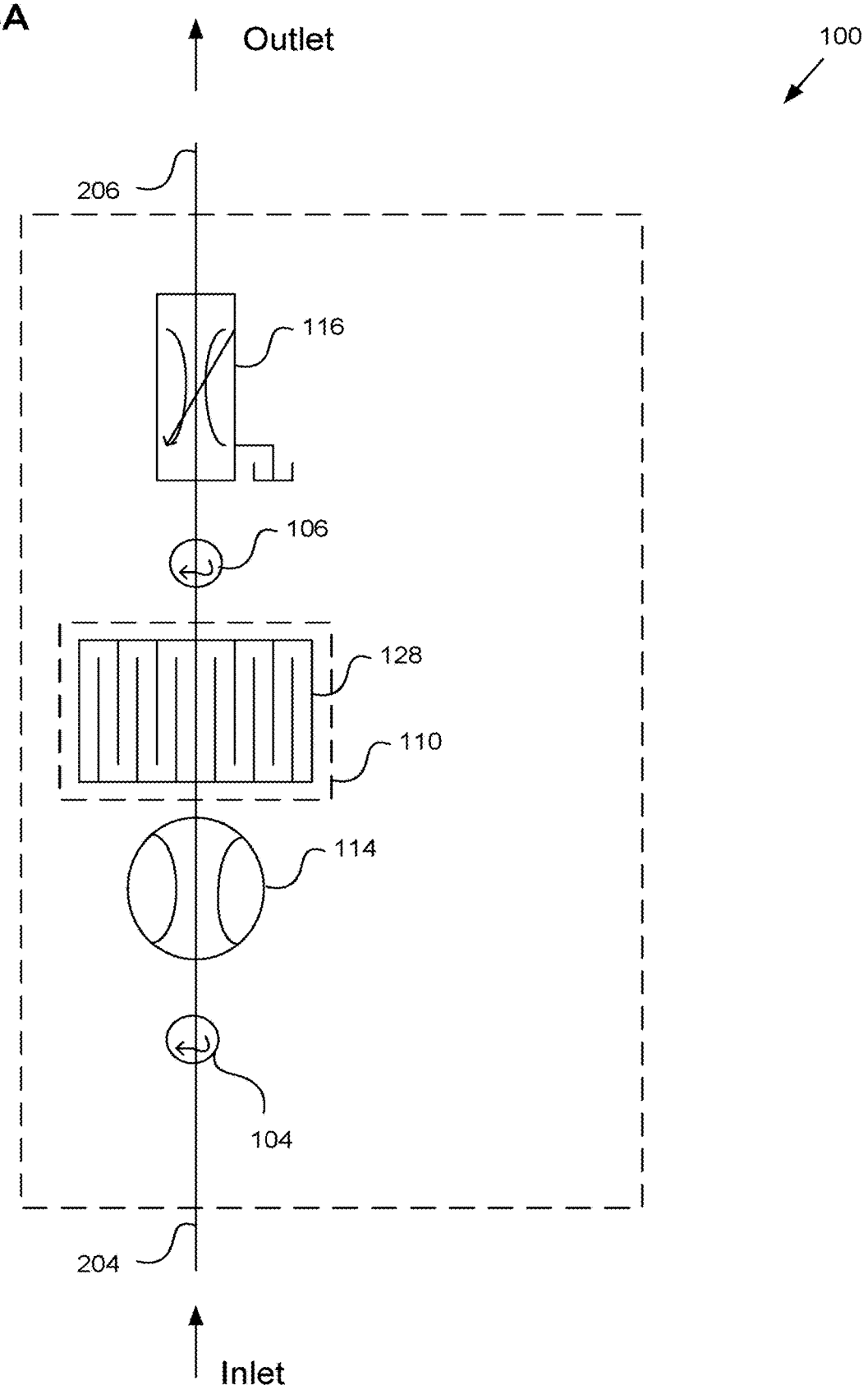
FIG. 3A is an overview diagram of a tankless electric water heater, according to one example.
Figure 3B:
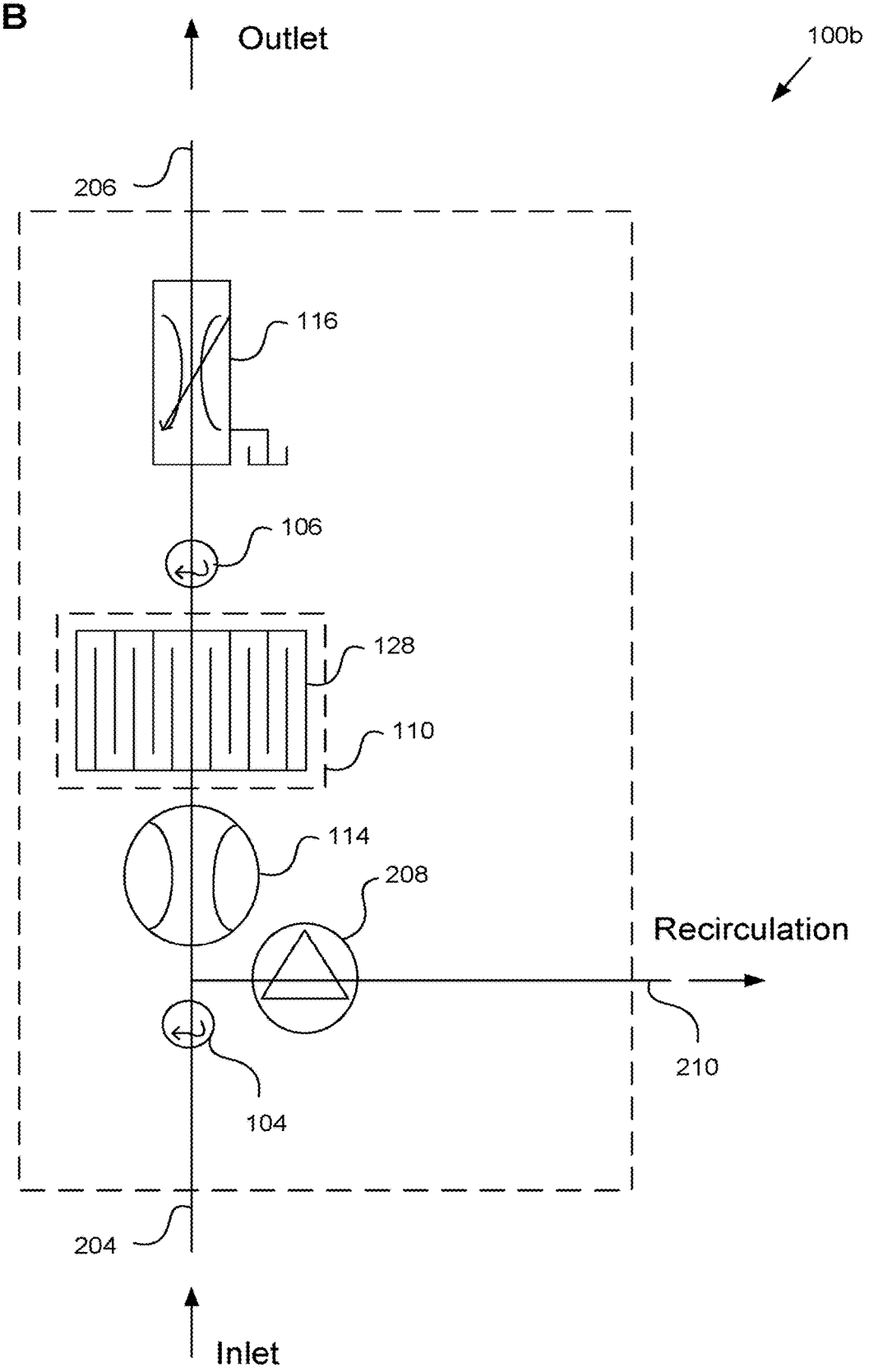
FIG. 3B is an overview diagram of a tankless electric water heater, according to one example.
Figure 3C:
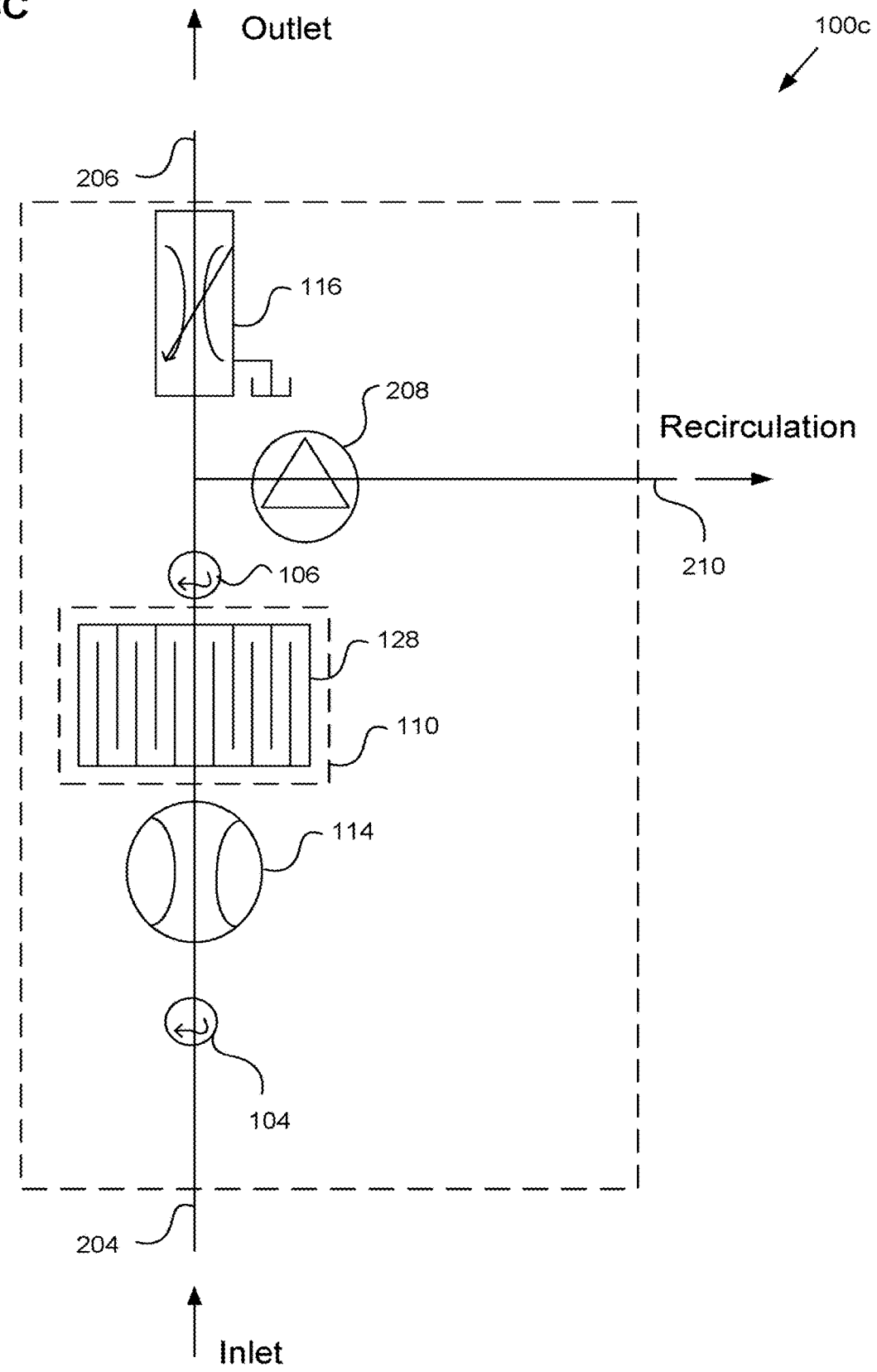
FIG. 3C is an overview diagram of a tankless electric water heater, according to one example.

Further, the tankless electric water heater 100*c* is connected to the recirculation pump 208 and the recirculation pipe 210 at a point after a heating element 128 (further described by FIG. 3C). The recirculation pump 208 recirculates water from the tankless electric water heater 100*c* through the recirculation pipe 210 and the second inlet pipe 202, back toward the liquid storage device 200. The inlet proportioning valve 214 may be connected to the second inlet pipe 202 at a point before the recirculation pipe 210, and the controller of the tankless electric water heater 100 may electrically control operation of the recirculation pump 208, and the opening and closing of the inlet proportioning valve 214 similar to that described with respect to FIG. 1B.

In one example, the recirculation pump 208 is connected to the outlet pipe 206 entirely downstream of the tankless electric water heater 100*c*, and the recirculation pipe 210 connects the outlet of the recirculation pump 208 to the second inlet pipe 202.

In one example, the liquid storage device 200 may be connected to the heat source 212 that provides energy to the liquid storage device 200 to heat water inside the liquid storage device 200. When the recirculation pump 208 and the recirculation pipe 210 exit before the tankless electric water heater 100*b* (as in one example of FIG. 1B) only the recirculation pump 208 and heat source 212 provide power to de-stratification. The effect on the tankless electric water heater 100*b* is less wear and tear, especially if recirculated water enters the recirculation pump 208 prior to an inlet fitting 124, or inlet port, or inlet, or prior to passing through the internal flow sensor 114. The effect on the liquid storage device 200 is more demand on the heat source 212 in order to elevate the temperature of the entire volume of water in the liquid storage device 200. The effect with respect to performance, with performance defined as the time it takes to destratify the tank to a uniform temperature, is somewhat slower than what it would take if the recirculation pump 208 and the recirculation pipe 210 are disposed downstream of the tankless electric water heater 100*c*, where recirculated water is heated by the heating element 128, as in one example of FIG. 1C. This performance gap would exist because of the power output difference in kilowatts (kW) between the heat source 212 and the tankless electric water heater 100*c*. The heat source 212 is limited to outputting 4.5 kW to heat the water at any particular moment. The tankless electric water heater 100*c* is able to output 7.2 kW of power in to heat the water at any particular moment in time. The reason for the power disparity is due to requirements of the National Electric Code (NEC). The heat source 212 is classified as a continuous use device, therefore the electrical circuit must be oversized by 125 percent. The tankless electric water heater 100*c* is classified as an intermittent duty device, so the electrical circuit can be sized to 100 percent of the load.

An advantageous feature of the tankless electric water heaters 100*a*-100*c* described by FIG. 1A through FIG. 1C, respectively, is that the tankless electric water heaters 100*a*-100*c* may be retrofit to existing infrastructure, electrical wiring, breaker system, plumbing, and an existing liquid storage device 200, rather than requiring more expensive and complicated replacement with a more powerful and/or higher capacity liquid heating device which requires a new and larger electrical circuit. An example of a more powerful heating device which requires a larger electrical circuit would be a dedicated whole home tankless water heater. An example of a higher capacity liquid heating device is a larger volume liquid storage tank, which may not physically fit where the previous device was. For example, this may be accomplished by removing a segment of one or more pipes, such as a portion connected to the liquid storage device 200 herein referred to as a first inlet pipe 204 and a portion connected to the end user referred to as an outlet pipe 206. Next the first inlet pipe 204 can be connected to an inlet fitting 124 of the tankless electric water heater 100 and the outlet pipe 206 can be connected to an outlet fitting 126 of the tankless electric water heater 100. The inlet fitting 124 and the outlet fitting 126 may be molded and fit to a variety of standard and non-standard pipe sizes. A plurality of tankless electric water heaters can be connected in parallel to the inlet pipe 204 and outlet pipe 206 or connected serially to each other to provide additional heating options for increased flow.

Figure 4A:
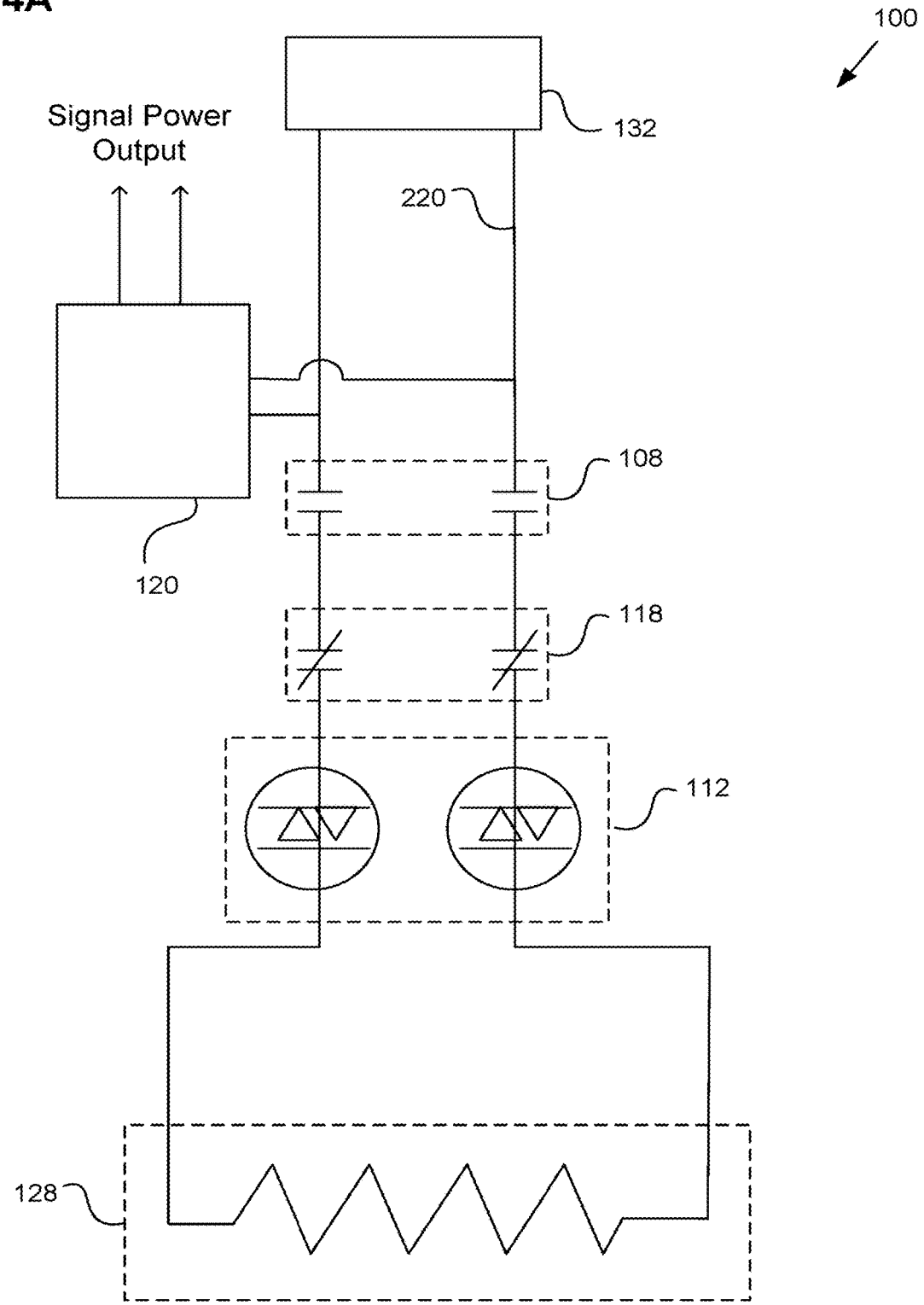
FIG. 4A is an overview diagram of an electrical system of the tankless electric water heater, according to one example.
Figure 4B:
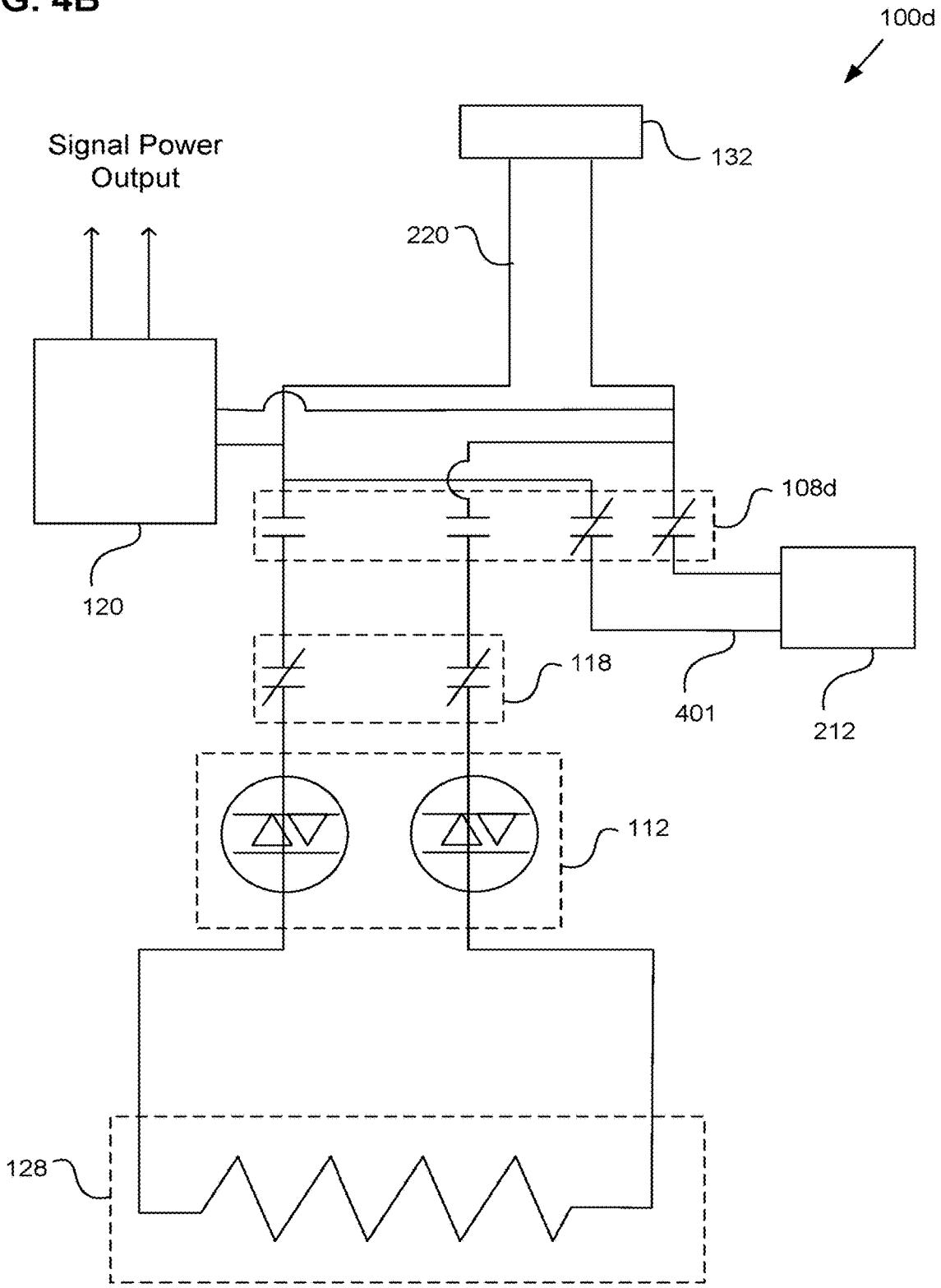
FIG. 4B is an overview diagram of an electrical system of the tankless electric water heater connected to an electrically controlled liquid storage device, according to one example.

Further, electrical supply lines 401 may be rerouted from the heat source 212 of the liquid storage device 200 and connected to the tankless electric water heater 100 as illustrated in FIG. 4B. The heat source 212 is thereafter electrically connected to and controlled by the tankless electric water heater 100 as described further herein based on flow, temperature, inputs and historical data. Another benefit is that the combination of the tankless electric water heater 100 and the liquid storage device 200 provides a longer duration of equivalent hot water than would be available from just the liquid storage device 200. The addition of the tankless electric water heater 100 to a liquid storage device 200 increases the effective volume of available hot water.

Another advantageous feature of the tankless electric water heaters 100*a*-100*c* described by FIG. 1A through FIG. 1C, respectively, is that the tankless electric water heaters 100*a*-100*c* may be combined with a fluid storage water heater as a complete assembly from the factory. This would provide all of the benefits of a stand-alone solution previously described. This would be particularly appealing for new construction or when a full replacement of the existing water heating infrastructure is needed as it will provide more hot water capacity in a smaller footprint without requiring a larger electrical supply circuit or plumbing changes from other commonly available storage water heating solutions on the market today.

Figure 2A:
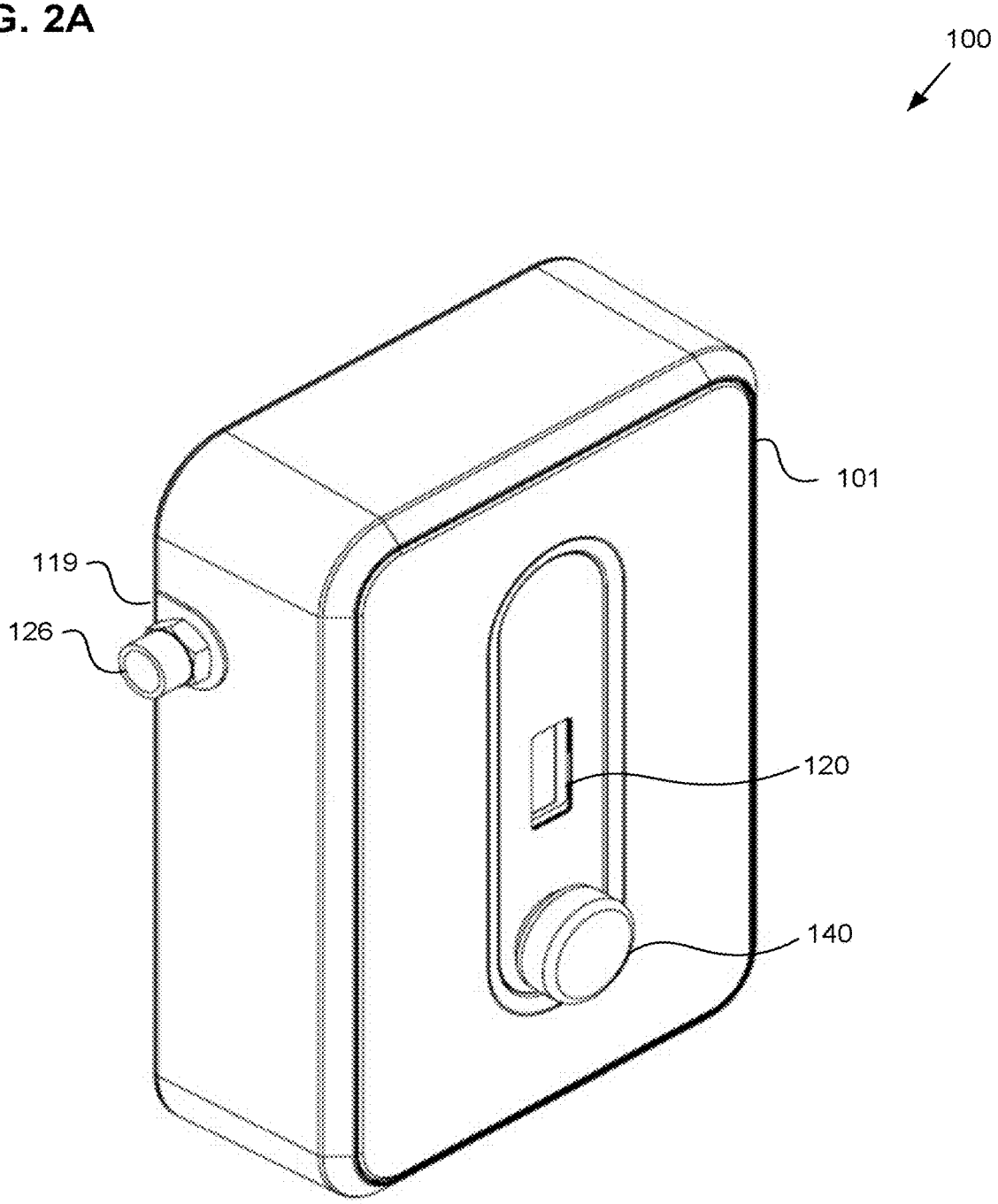
FIG. 2A is a first perspective view of a tankless electric water heater, according to one example.

FIG. 2A is a first perspective view of the tankless electric water heater 100, according to one example. The tankless electric water heater 100 includes a cover panel 101 enclosing the internal components of the tankless electric water heater 100, an outlet fitting 126, or outlet port, or outlet, connected on a first side of the tankless electric water heater 100 to a second mounting tab 119, a controller 120 connected to a second side of the tankless electric water heater 100, and a control knob 140 connected to the controller 120. The control knob 140 is provided for a user to provide input to the controller 120, for example scrolling through various user menus and temperature set points.

Figure 2B:
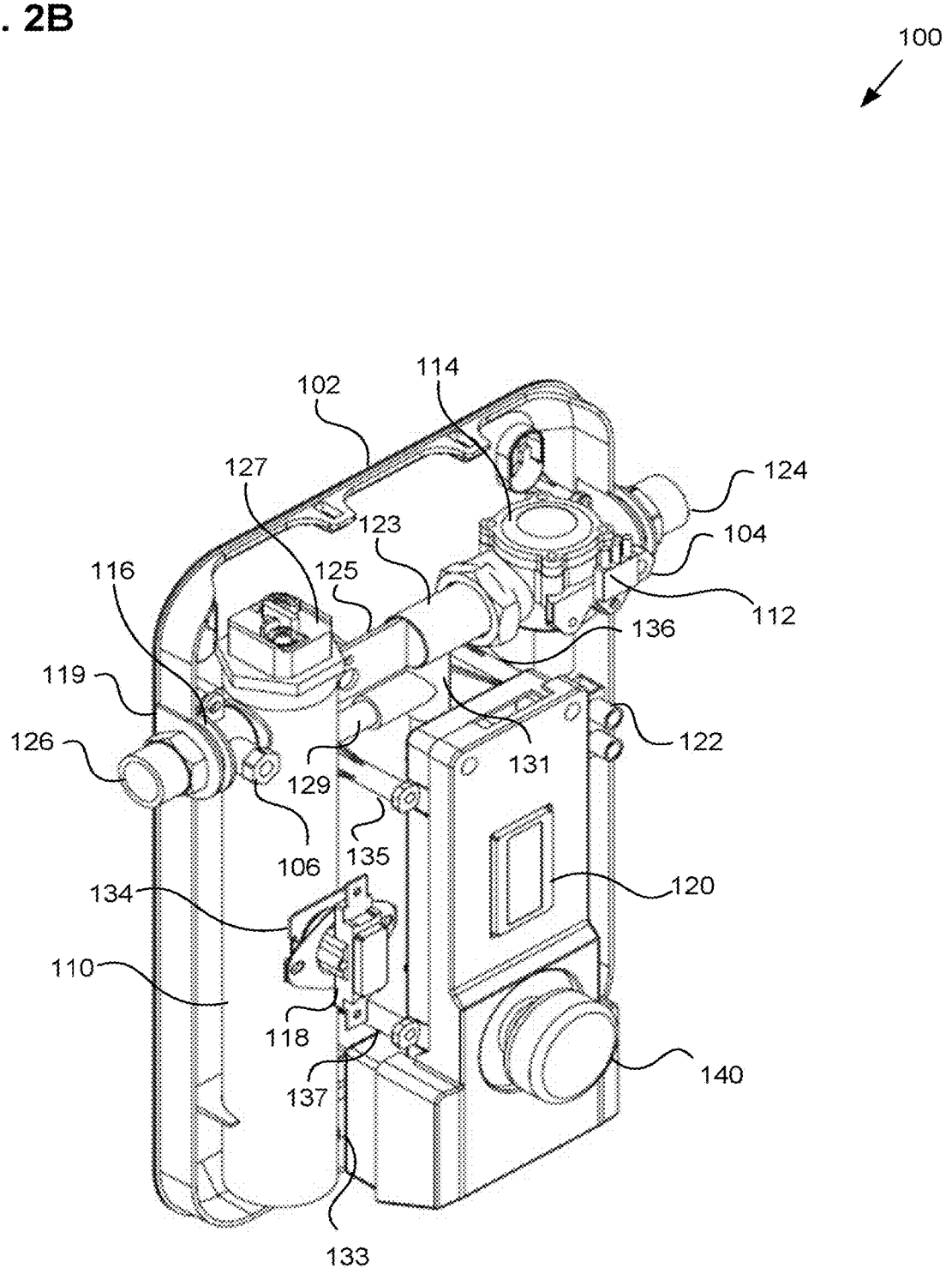
FIG. 2B is a first perspective view of the tankless electric water heater without a cover, according to one example.

FIG. 2B is a first perspective view of the tankless electric water heater 100 without the cover panel 101, according to one example. The tankless electric water heater 100 includes an inlet fitting 124 connected to a mounting plate 102. An inlet temperature sensor 104, a high speed switch 112, and a flow sensor 114 are connected to the inlet fitting 124. The inlet fitting 124 is further connected to a first conduit 123. A second conduit 131 is connected to the first conduit 123, a third conduit 129 and a fourth conduit 133 (labeled but not visible in this view) which connect the conduit 131 to a heating chamber 110. A tab 125 also connects the first conduit 123 to the heating chamber 110.

A heating element 128 (not shown) is connected to an electrical connection 127, with the heating element 128 portion disposed within the heating chamber 110. The electrical connection 127 is connected to the high speed switch 112, and the high speed switch is controlled by a controller 120 to modulate power to the heating element 128 (further described by FIG. 4A and FIG. 4B). A control knob 140 connected to the controller 120 provides one way of operating the controller 120.

A first mounting pin 135, a second mounting pin 136, a third mounting pin 137, and a fourth mounting pin 138 (not visible in this view) are connected to the mounting plate 102 and secure the controller 120 to the mounting plate 102.

An outlet temperature sensor 106 is connected to the heating chamber 110, and a proportioning valve 116 connected to the outlet temperature sensor 106 controls the flow of liquid exiting the tankless electric water heater 100 via the outlet fitting 126. In one example (not shown), the outlet temperature sensor 106 is located upstream of the heating chamber 110 and the proportioning valve 116. In another example, the outlet temperature sensor 106 is located downstream of the heating chamber 110 but upstream of the proportioning valve 116 and outlet fitting 126. A downstream direction is from the inlet fitting 124 to the outlet fitting 126.

A temperature safety switch 118 is connected to the outside of the heating chamber 110 by a switch mount 134. The controller 120 and a terminal block 122 are further connected to the mounting plate 102.

Water flows into the inlet fitting 124, from for example the first inlet pipe 204, at which point the inlet temperature sensor 104 detects a water temperature and the flow sensor 114 detects a flow rate. The water then enters the first conduit 123 and then the second conduit 131. Based on a temperature setting of the tankless electric water heater 100, the controller 120 activates the heating element 128 in the heating chamber 110 at a power setting based on the detected temperature by the inlet temperature sensor 104 to increase the temperature of the water. The tab 125, which provides structural support for the heating chamber 110 and the first conduit 123, may also, in some examples, transfer heat through conduction from the heating chamber 110 to the first conduit 123, the second conduit 131, the third conduit 129, and the fourth conduit 133, thereby pre-heating the water that flows into the first conduit 123 and the second conduit 131 before the water enters the heating chamber 110 by way of the third conduit 129 and the fourth conduit 133.

Further, the third conduit 129, the fourth conduit 133, and the second conduit 131 form a loop with the heating chamber 110, allowing for balanced water flow into the heating chamber 110. In one example, the heating chamber 110 and the heating element 128 may be of a type described by U.S. patent application Ser. No. 13/835,346, the entire contents of which are hereby incorporated by reference herein. Alternatively, the heating element can be any other heating element as would be understood by one of ordinary skill in the art.

Once the water has flowed through the heating chamber 110, the water then flows past the outlet temperature sensor 106 to the outlet proportioning valve 116. In one example, the outlet proportioning valve 116 is a solenoid valve, an electro-proportional valve, or an electrohydraulic servo valve that can be activated by the controller 120 to seal a portion or all of the liquid flow exiting the tankless electric water heater 100. If the outlet proportioning valve 116 is not fully closed, water flows through the outlet proportioning valve 116, and through the outlet fitting 126 to supply another device or end user. The outlet temperature sensor 106 detects a temperature of water exiting the heating chamber 110. The controller 120 detects temperatures at the inlet temperature sensor 104, the outlet temperature sensor 106, and the water flow rate at the flow sensor 114, and controls the operation of the outlet proportioning valve 116 and the heating element 128 as a function of at least one of the inlet temperature sensor 104 measurement, the outlet temperature sensor measurement 106 and the water flow rate to ensure that water is heated to an appropriate temperature and can continue to be heated at the temperature based on the flow rate. The amount of power (in kilowatts) needed to raise the temperature of an amount of water, defined as a flow rate (Gallons Per Minute), by a specific temperature difference ($\Delta T$, in Fahrenheit), may be determined by an equation: Power (kW)=[Flow Rate (GPM)×$\Delta T$ (° F.)]/6.83

In one example, the controller 120 uses the equation above to determine how much power to provide to the heating element 128 based on the difference between a set point temperature 130 and the temperature detected at the outlet temperature sensor 106 (where the set point temperature 130 is greater than a reading of outlet temperature sensor 106), and the detected flow rate of the flow sensor 114.

In another example, the controller 120 uses the equation above to determine an amount the outlet proportioning valve 116 can be open to maintain a flow rate exiting the tankless electric water heater 100 based on a temperature difference between what is detected by the outlet temperature sensor 106 and the inlet temperature sensor 104, and an amount of power supplied to the heating element 128.

If electrical load or heat buildup exceeds the design limit, the temperature safety switch 118 may be triggered by the controller 120 to limit or shut down electrical power to the heating element 128, reducing the risk of damage or equipment failure and thereby helping to ensure safe operation.

The terminal block 122 provides electrical power connections between electrical supply lines 220 and the tankless electric water heater 100 (FIG. 3A), including a switching mechanism 108, the heating element 128, the controller 120, the high speed switch 112, and the temperature safety switch 118, as well as to electrical supply lines 401 to supply power to a heat source 212 of the liquid storage device 200. Further, the terminal block 122 is connected to the controller 120, allowing the controller 120 to detect and control the operation of the tankless electric water heater 100.

In one example, if the controller 120 detects a temperature below a threshold at the inlet temperature sensor 104 and/or the outlet temperature sensor 106, the controller 120 may turn on or increase power to the heating element 128 or the heat source 212, if applicable, to increase water temperature to a minimum temperature at the outlet temperature sensor 106.

In another example, if the controller 120 detects a temperature below a set point temperature 130 at the outlet temperature sensor 106, the controller 120 may close the outlet proportioning valve 116.

In another example, if the controller 120 detects a temperature above a set point temperature 130 at the outlet temperature sensor 106, the controller 120 may close the outlet proportioning valve 116.

In another example, if the controller 120 detects the temperature exceeds a threshold at the outlet temperature sensor 106, the controller 120 can close the outlet proportioning valve 116 to prevent water from flowing out at an excessive and potentially dangerous temperature. Further, the controller 120 may also reduce or turn off power to the heating element 128 of the tankless electric water heater and/or the heat source 212 of the liquid storage device 200 to allow any water remaining within the tankless electric water heater 100 and the liquid storage device 200 to cool.

Although only one heating chamber 110 is illustrated in FIG. 2B, in other implementations, multiple heating chambers 110 could be provided and linked serially or in parallel via additional conduits thereby providing additional heating capacity for larger flows of liquid. Further, power may be distributed to the heating chambers 110 by load shedding if total power demand of the heating chambers 110 exceeds available power supply. Multiple liquid storage devices 200 and multiple heat sources 212 could be provided and linked serially or in parallel. Power may then also be distributed to the heat sources 212 via the controller 120 by load shedding if total power demand of the heat sources and heating chambers 110 exceeds available power supply.

In one example, at least one of the set of the first conduit 123, the second conduit 131, the tab 125, the third conduit 129, the fourth conduit 133, and the heating chamber 110 are formed from metals or engineered polymers.

In another example (not shown), the outlet temperature sensor 106 is disposed downstream of both the heating chamber 110 and the outlet proportioning valve 116.

In another example, the outlet temperature sensor 106 is disposed downstream of the heating chamber 110 and upstream of the outlet proportioning valve 116, while a second outlet temperature sensor (not shown) is located downstream of the outlet proportioning valve 116, allowing measurement of temperature differences that may occur as a result of the position or actuation of the outlet proportioning valve 116.

Figure 2C:
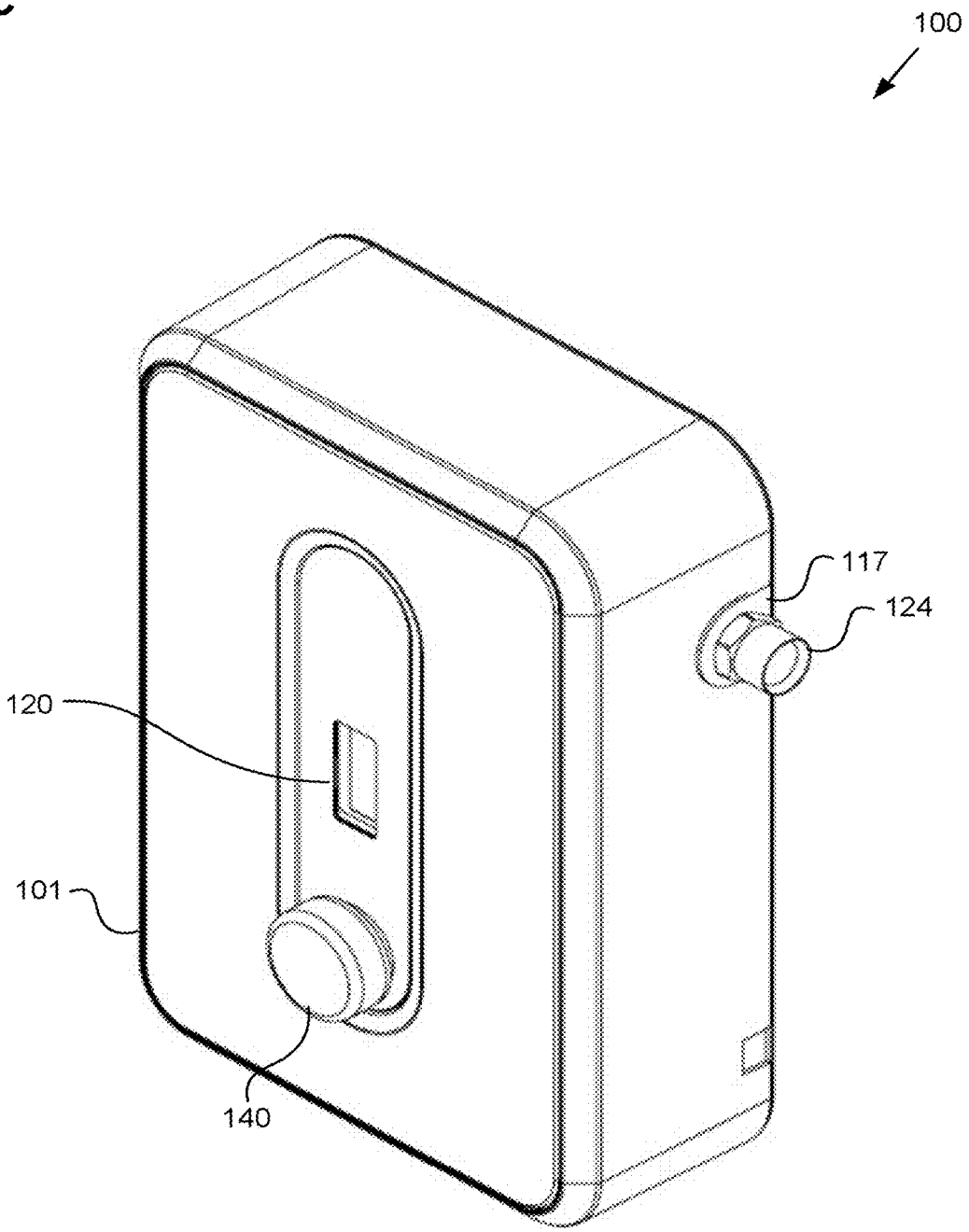
FIG. 2C is a second perspective view of the tankless electric water heater, according to one example.

FIG. 2C is a second perspective view of the tankless electric water heater 100, according to one example. The tankless electric water heater 100 includes the cover panel 101 enclosing the internal components of the tankless electric water heater 100, the inlet fitting 124 and a first mounting tab 117 connected on a third side of the tankless electric water heater 100, and the controller 120 and the control knob 140 for controlling inputs of the tankless electric water heater 100 connected to the second side of the tankless electric water heater 100.

Figure 2D:
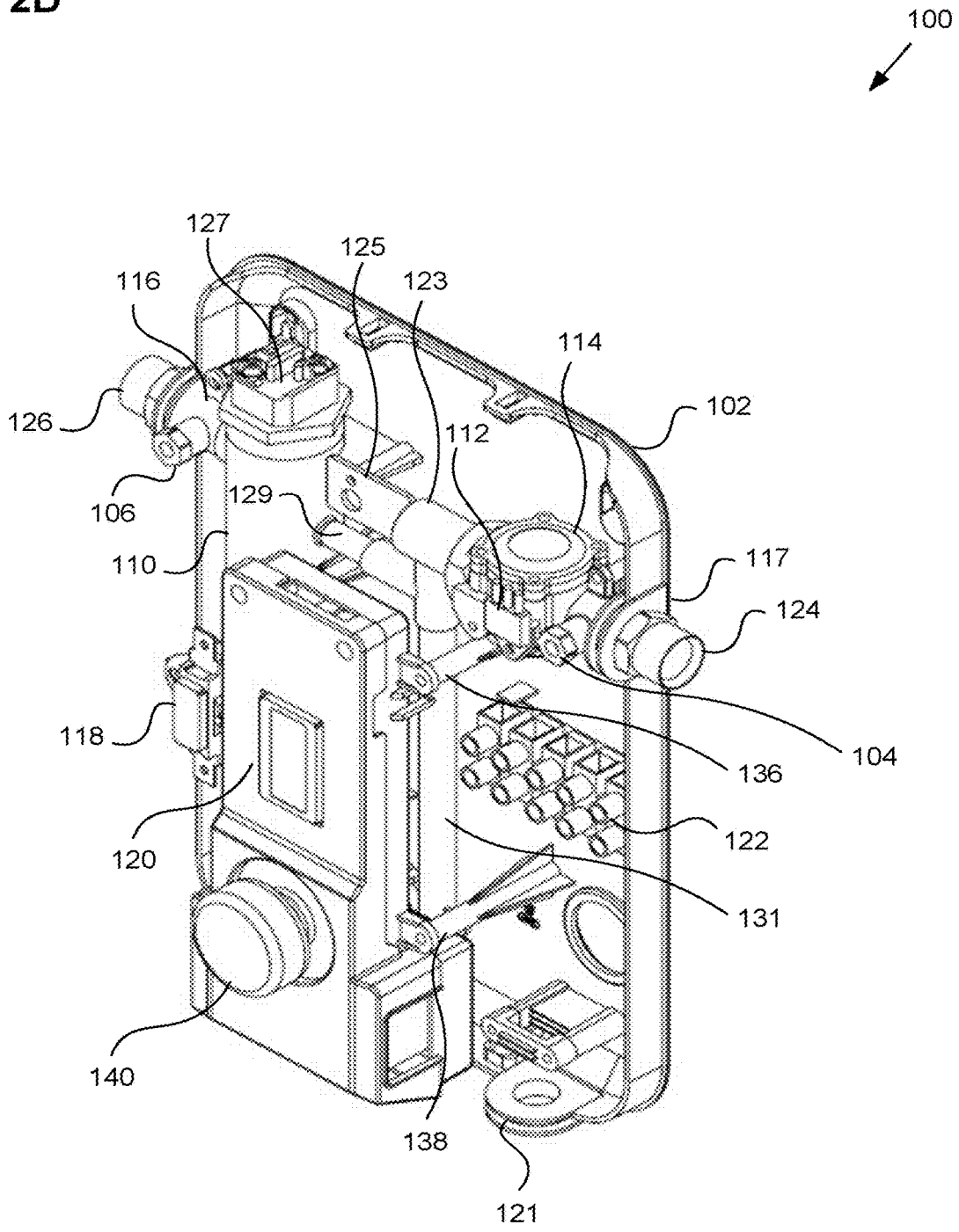
FIG. 2D is the second perspective view of the tankless electric water heater system without a cover, according to one example.

FIG. 2D is a second perspective view of a tankless electric water heater 100 without the cover 101, according to one example. The tankless electric water heater 100 is identical to that described by FIG. 2B, but shown from the second perspective view, where the terminal block 122 is fully visible. Further, the first mounting tab 117, a third mounting tab 121, the second mounting pin 136, and the fourth mounting pin 138 are also visible in this view, and connected to the mounting plate 102. The third mounting tab 121 provides support for a power cable (not shown) for the tankless electric water heater 100 to supply the heat source 212 of the liquid storage device 200. The third mounting tab 121 is further connected to the mounting plate 102.

Figure 2E:
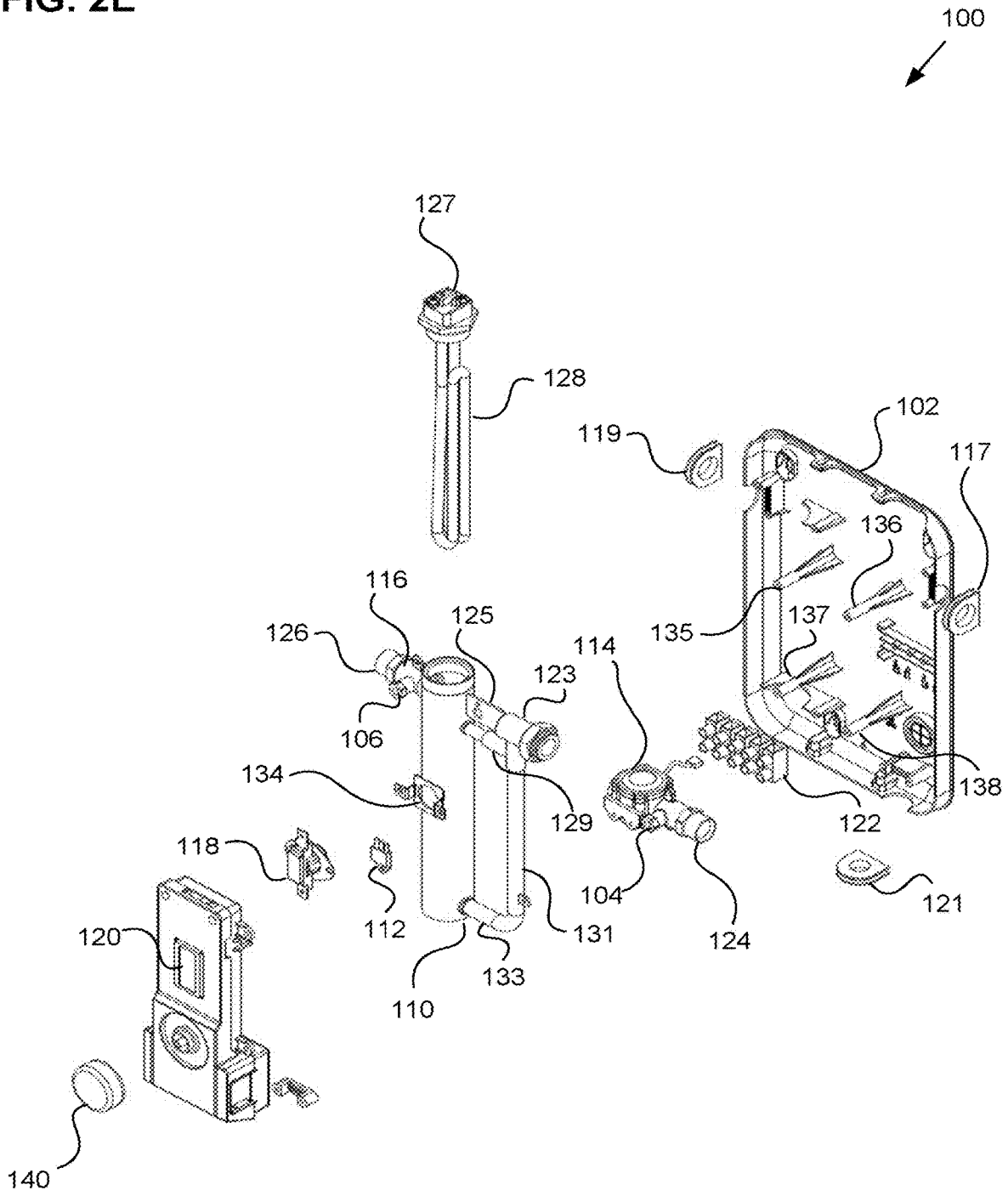
FIG. 2E is an exploded second perspective view of the tankless electric water heater system, according to one example.

FIG. 2E is an exploded second perspective view of the tankless electric water heater 100, according to one example. The tankless electric water heater 100 is shown without the cover panel 101. The tankless electric water heater 100 includes the identical components as those shown in FIGS. 2A through 2D and like designations are therefore repeated.

Further, the first mounting pin 135, the second mounting pin 136, the third mounting pin 137, and the fourth mounting pin 138 are connected to the mounting plate 102 and support the controller 120.

Figure 2F:
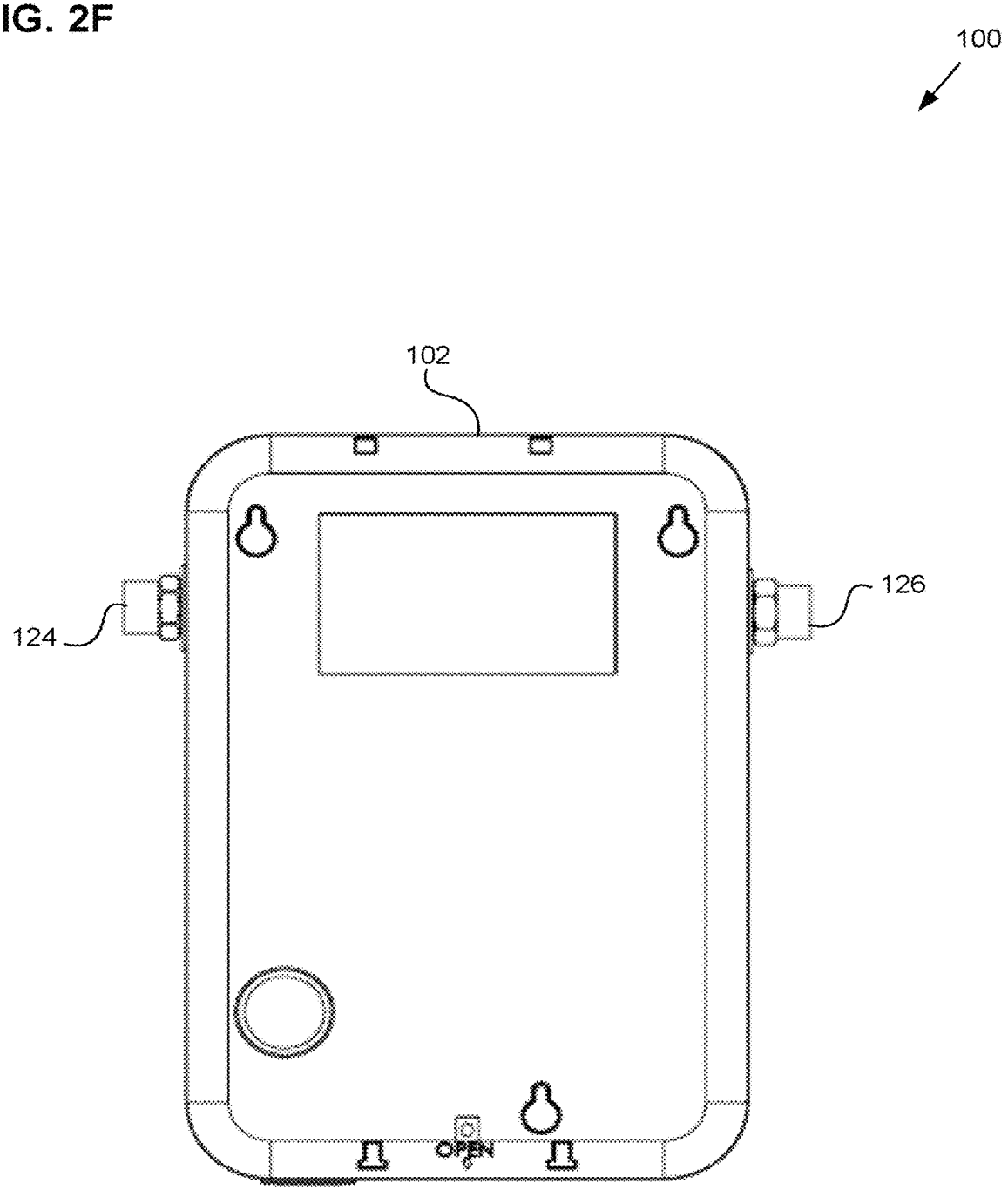
FIG. 2F is a third view of the tankless electric water heater system, according to one example.

FIG. 2F is a third view of the tankless electric water heater 100, according to one example. The tankless electric water heater 100 includes the mounting plate 102, the inlet fitting 124, and the outlet fitting 126.

Figure 2G:
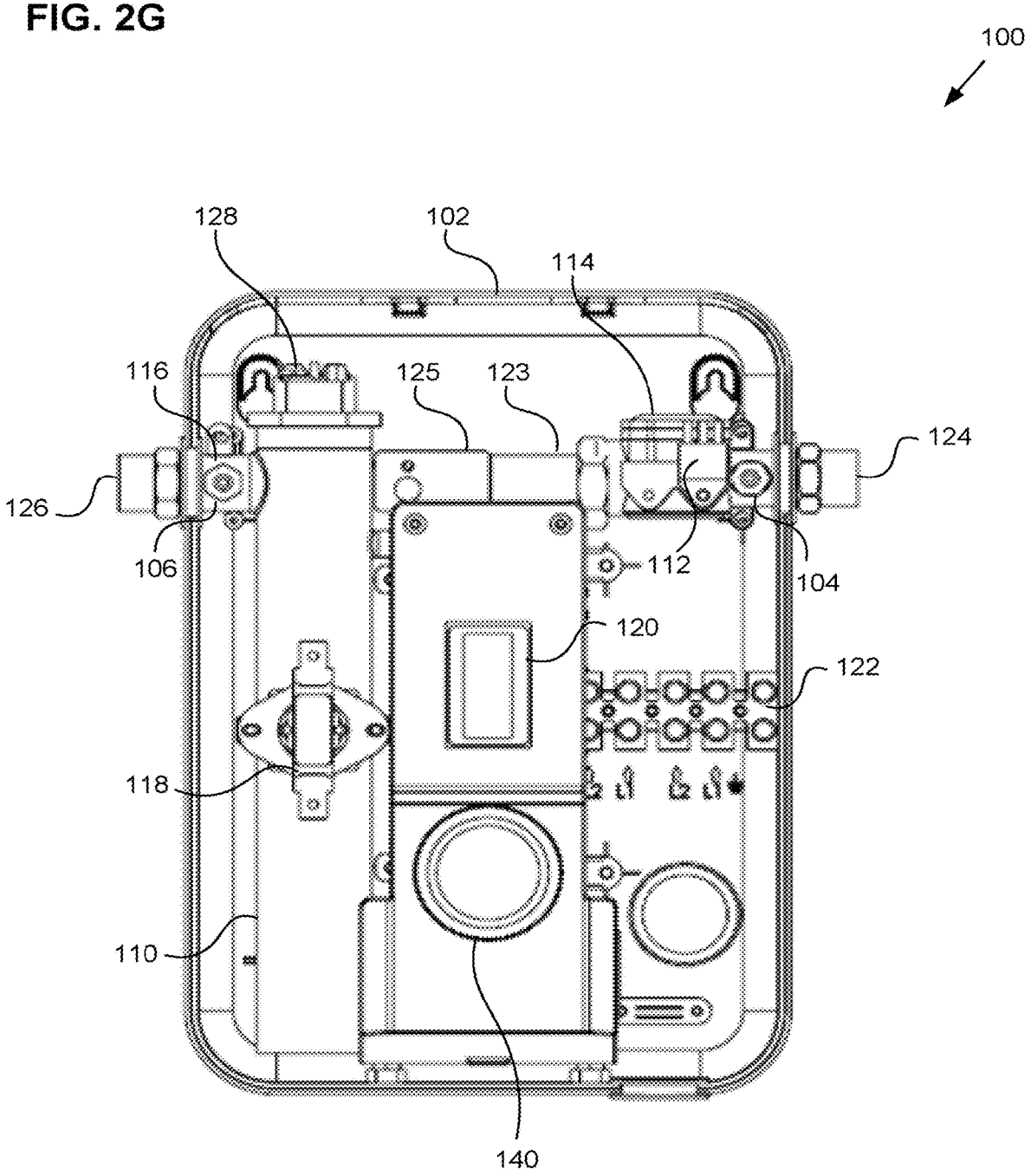
FIG. 2G is a fourth view of the tankless electric water heater system without a cover, according to one example.

FIG. 2G is a fourth view of the tankless electric water heater 100 without the cover panel 101, according to one example. The tankless electric water heater 100 includes similar features as those previously illustrated and therefore like designations are repeated.

Figure 2H:
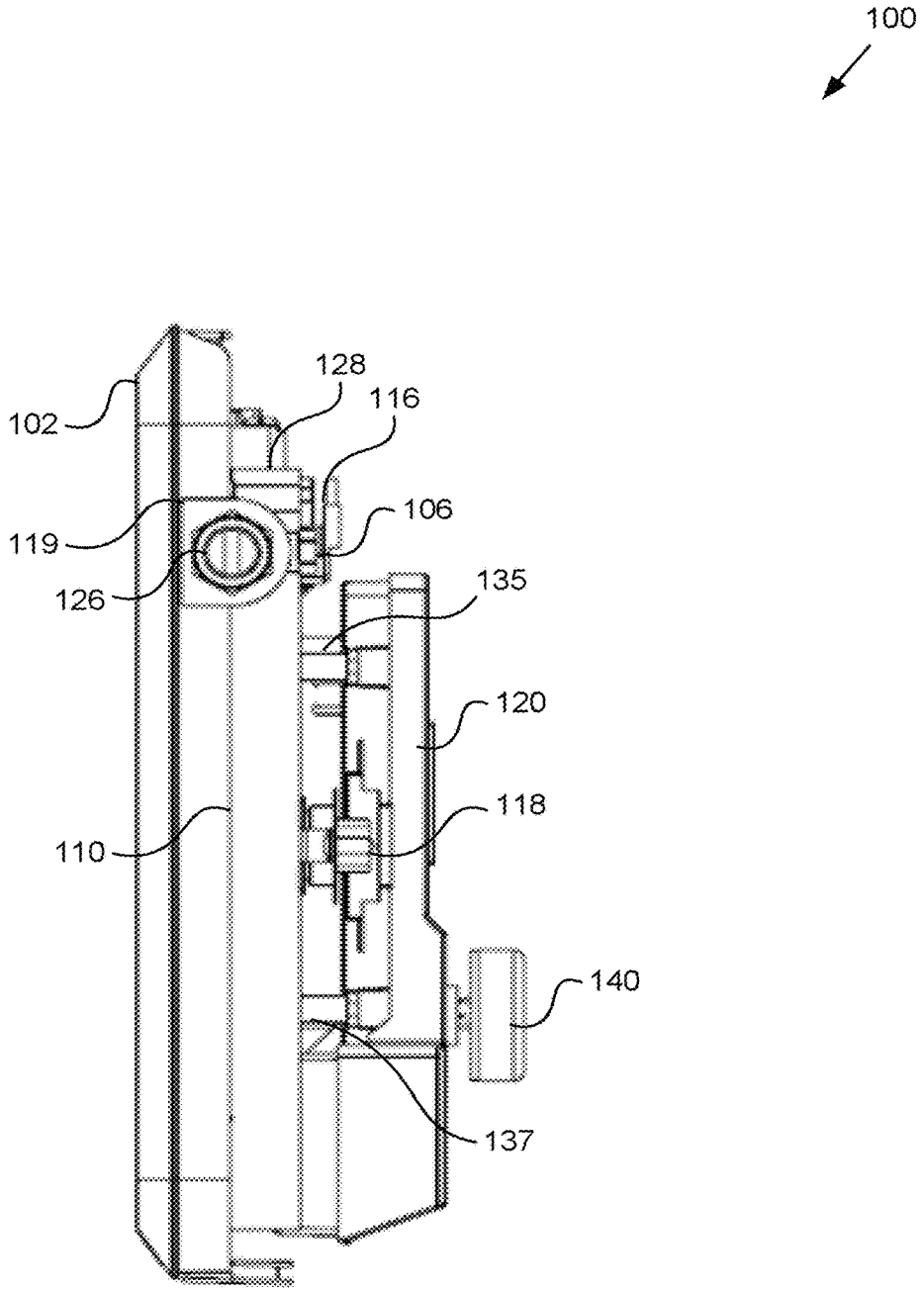
FIG. 2H is a fifth side view of the tankless electric water heater system without a cover, according to one example.

FIG. 2H is a fifth view of the tankless electric water heater 100 without the cover 101, according to one example. From the fifth view, the tankless electric water heater 100 having the mounting plate 102, the second mounting tab 119, the outlet fitting 126, the heating chamber 110, the heating element 128, the outlet proportioning valve 116, the outlet temperature sensor 106, the controller 120, the temperature safety switch 118, the first mounting pin 135, and the third mounting pin 137 are illustrated and are all connected in the same way as described by FIG. 2A through FIG. 2G.

FIG. 3A is an overview diagram of the tankless electric water heater 100, according to one example. The tankless electric water heater 100 includes the inlet temperature sensor 104 connected to the flow sensor 114, the heating element 128 disposed within the heating chamber 110 and connected to the flow sensor 114, the outlet proportioning valve 116 connected to the heating element 128, and the outlet temperature sensor 106 connected to the outlet proportioning valve 116. Further, the tankless electric water heater 100 is connected to the first inlet pipe 204 and connected to the outlet pipe 206.

Water comes into the tankless electric water heater 100 via the first inlet pipe 204, and then flows by the inlet temperature sensor 104 toward the flow sensor 114. The inlet temperature sensor 104 measures the temperature of water as it enters the tankless electric water heater 100 before water is further heated within the tankless electric water heater 100 and transmits the measurement to the controller 120. The flow sensor 114 measures the rate at which water is flowing into the tankless electric water heater 100 and transmits the measurement to the controller 120. The liquid then flows into the heating chamber 110 and past the heating element 128. If the heating element 128 is provided with electrical power by the controller 120 based on the measurements, the heating element 128 heats the water to a temperature controlled by the controller 120. Once the water is past the heating element 128, the water flows past the outlet temperature sensor 106 toward the outlet proportioning valve 116. If the outlet proportioning valve 116 is open, water flows through the outlet proportioning valve 116 and out of the tankless electric water heater 100 through the outlet pipe 206. Otherwise, if the outlet proportioning valve 116 is not open, water does not flow through the outlet proportioning valve 116 and water does not flow out of the tankless electric water heater 100.

FIG. 3B is an overview diagram of the tankless electric water heater 100*b*, according to one example. The tankless electric water heater 100*b*, similar to that of FIG. 3A, further includes the recirculation pump 208 and the recirculation pipe 210. Identical elements from FIG. 3A have the same designations repeated.

In one example, the recirculation pump 208 is connected to the tankless electric water heater 100*b* at a point after the inlet temperature sensor 104 and before a heating element 128. The recirculation pump 208 is further connected to the recirculation pipe 210, and recirculates water, which may be at an elevated temperature, depending on an operation of the heating element 128, from the tankless electric water heater 100*b* through the recirculation pipe 210 and back toward the liquid storage device 200 as illustrated and described with respect to FIG. 1B. In one example, water is only recirculated to the liquid storage device 200 to reduce stratification and is not heated further by the tankless electric water heater 100*b*.

FIG. 3C is an overview diagram of the tankless electric water heater 100*c*, according to one example. The tankless electric water heater 100*c*, similar to that of FIG. 3B, further includes the recirculation pump 208 and the recirculation pipe 210. Identical elements from FIG. 3B have the same designations repeated.

In one example, the recirculation pump 208 is connected to the tankless electric water heater 100*c* at a point downstream of the heating element 128. The recirculation pump 208 is further connected to the recirculation pipe 210, and recirculates water, which may be at an elevated temperature, depending on an operation of the heating element 128, from the tankless electric water heater 100*c* through the recirculation pipe 210 and back toward the liquid storage device 200 as illustrated and described by FIG. 1C. In addition to reducing stratification, water recirculated to the liquid storage device 200 may also be heated by the tankless electric water heater 100*c*, further elevating the temperature of the water in the liquid storage device 200.

FIG. 4A is an overview diagram of an electrical system of the tankless electric water heater 100 (or 100*b*/100*c*), according to one example. The tankless electric water heater 100 includes the controller 120 connected to electrical supply lines 220. The electrical supply lines 220 are also connected to a switching mechanism 108, the temperature safety switch 118, a high speed switch 112, and the heating element 128. The electrical supply lines 220 are further connected to a power source 132 such as a home electrical circuit. The controller 120 controls the amount of power provided to the heating element 128 by modulating the electrical power directed through the high speed switch 112. The controller 120 further controls electrical power to the high speed switch 112 by controlling the switching mechanism 108 and by maintaining a temperature level or power level below the maximum threshold of the temperature safety switch 118. Water is heated by the heating element 128 as it passes through the heating chamber 110 (shown, for example, in FIG. 2B). Electrical power may also be used by the controller 120 to communicate with, operate, and control various sensors, valves, pumps, wired or wireless communication devices, data storage devices, and battery backup systems as described herein.

In one example, further described by FIG. 3A, the controller 120 detects an amount of water flowing into the tankless electric water heater 100 using measurements from the flow sensor 114, detects a water temperature coming into the tankless electric water heater 100 using measurements from the inlet temperature sensor 104, controls an amount of water leaving the tankless electric water heater 100 using the outlet proportioning valve 116, detects a water temperature exiting the heating element 128 using measurements from the outlet temperature sensor 106, and compares this to a set point temperature 130. The controller 120 controls the amount of electrical power directed to the heating element 128 to heat the water to meet the set point temperature 130 and controls the outlet proportioning valve 116 based on the temperature of the water measured by the outlet temperature sensor 106. For example, the controller 120 can control the outlet proportioning valve 116 to close off the water flow path from the heating chamber 110 to the outlet fitting 126 until the temperature measured by the outlet temperature sensor reaches the set point temperature 130. At this point, the controller 120 can then open the outlet proportioning valve 116 to an amount such that, based on measurements from the inlet temperature sensor 104 and flow sensor 112, the water can continue to be heated by the heating element 128 at the set point temperature 130 continuously as the water passes through the tankless electric water heater 100.

Further, in a case where the tankless electric water heater 100 is connected to a recirculation pipe 210, a recirculation pump 208 and an inlet proportioning valve 214 (as described by FIG. 1B), the controller 120 may detect or control operation of the inlet proportioning valve 214 and the recirculation pump 208.

FIG. 4B is an overview diagram of an electrical system of a tankless electric water heater 100*d* connected to an electrically controlled liquid storage device 200, according to one example. Here, a switching mechanism 108*d* of FIG. 4B includes additional connections via electrical supply lines 401 to the heat source 212 for the liquid storage device 200 that allows the controller 120 to control and specify an amount of electrical power supplied to the heat source 212.

In one example, the liquid storage device 200 is an electric water heater and the heat source 212 electrically heats water in the liquid storage device 200. The controller 120, through operation of the switching mechanism 108*d*, may divert some or all of the electrical power from the heat source 212 to the heating element 128 to provide greater heating capability in the tankless electric water heater 100*d*, such as in a case where heated water is needed immediately.

In another example, the controller 120 may operate the switching mechanism 108*d* to divert some or all of the available electrical power to the heat source 212 to provide greater heating capability to the liquid storage device 200, such as in a case where the controller 120 anticipates a need for a quantity of heated water based on historical usage, through one or more learning algorithms, or a predetermined water heating schedule or time interval.

In another example, the controller 120 may operate the switching mechanism 108*d* to shut down electrical power to the tankless electric water heater 100*d* and the liquid storage device 200. Further, electrical power may be reapplied if the controller 120 detects the possibility water in the system is approaching a low temperature or freezing temperature to prevent system damage or failure. This mode of operation is useful for conserving energy during an extended period without use, for example in an overnight or vacation mode.

Figure 5:
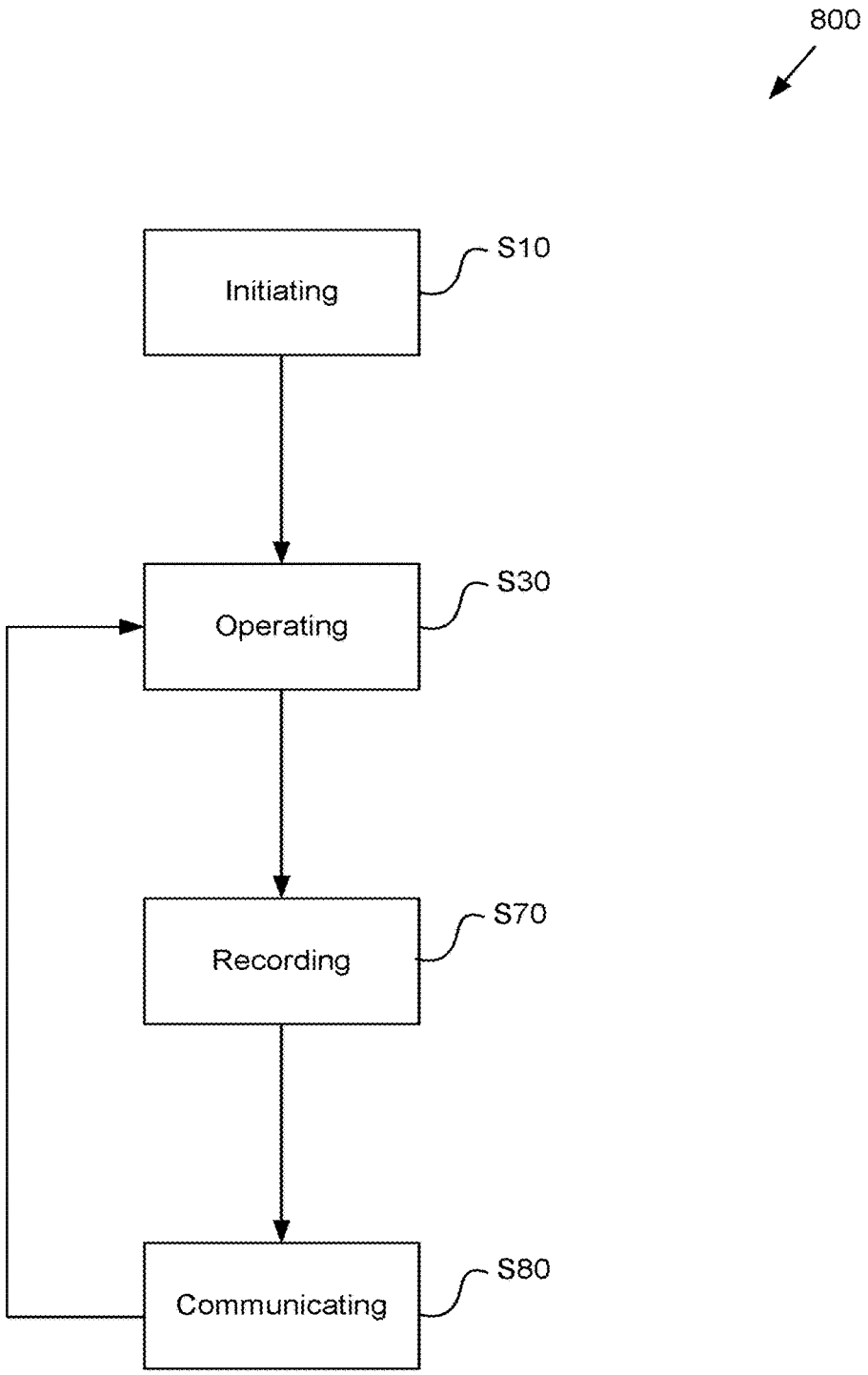
FIG. 5 is a process diagram for the tankless electric water heater system when connected to a liquid storage device, according to one example.

In another example, the controller 120 may, whether operating on primary or backup power, alert a user of a system error, leak, or failure through a display 920 on the tankless electric water heater 100 and/or through communication with remote devices and networks using wired or wireless methods such as described by a communication process S80 described by FIG. 5.

In another example, the high speed switch 112 is a triac, and the controller 120 modulates power applied to the heating element 128, in order to achieve an outlet water temperature approximately matching the set point temperature 130. The controller 120 may modulate power to the heating element 128 based on various parameters such as flow, inlet/outlet temperature, and information/data collected from other interfacing apparatuses. The control algorithm may be based on the parameters listed above in conjunction with maximum power settings of the heating element 128 and the set point temperature 130. The control algorithm may be based on a PID-type (proportional-integral-derivative) control loop feedback mechanism, using pulse width modulation at a calculated frequency, to increase or decrease power supplied to the heating element 128 to control outlet water temperature.

An advantageous feature of the tankless electric water heater 100*d*, is when it is installed in conjunction with an electric heat source 212 of a liquid storage device 200, the electrical circuit to both devices may be shared. The controller 120 of the tankless electric water heater 100 is always supplied power and will control when to switch between supplying power to the electric heat source 212 of the liquid storage device 200 or the heating element 128 of the tankless electric water heater 100, but generally not to both the heat source 212 and the heating element 128 at any one particular time. This mitigates the cost of installing a separate electrical circuit which other tankless electric water heaters need when used as a booster.

Figure 4C:
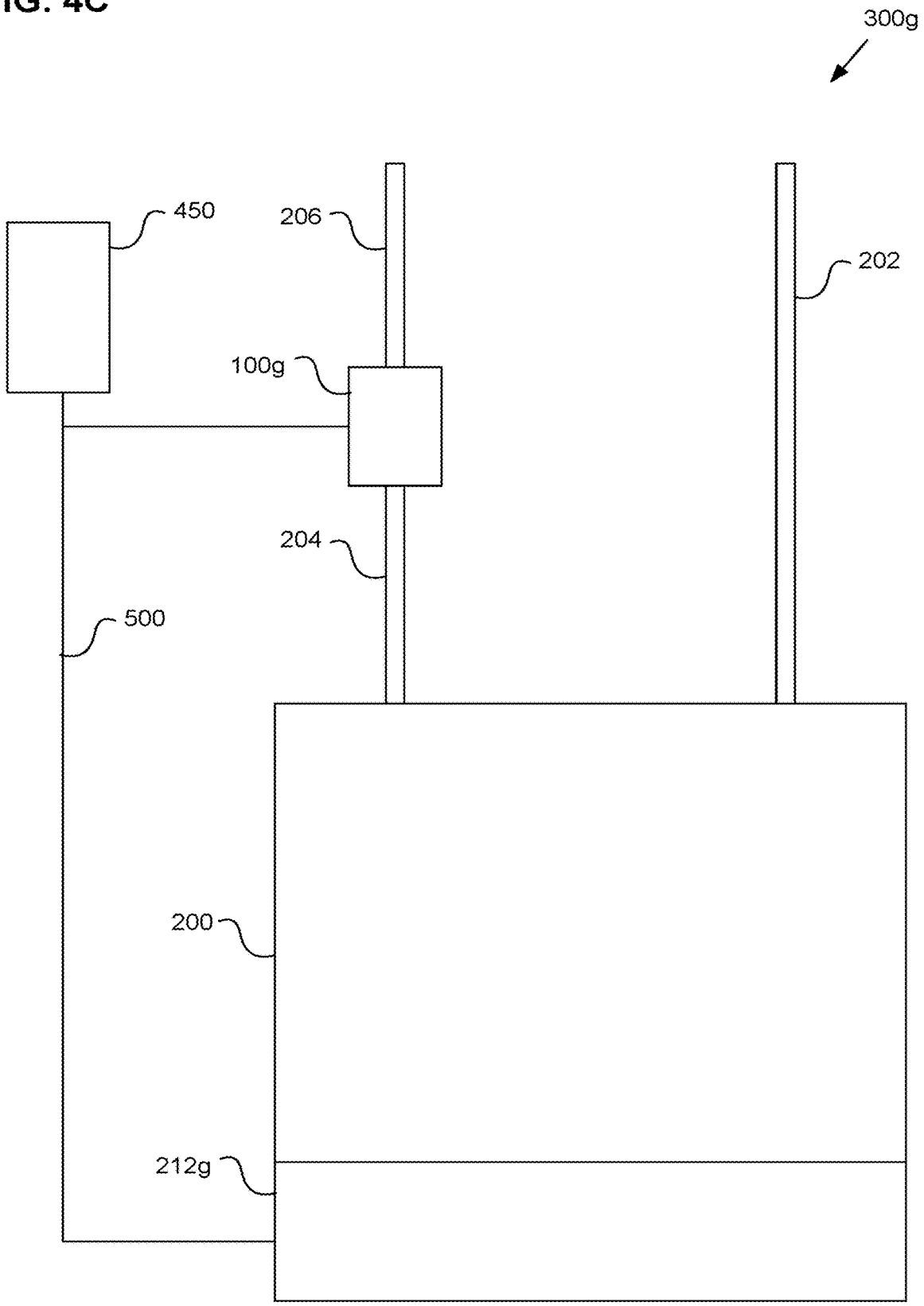
FIG. 4C is an overview diagram of a gas-fired liquid heating system, according to one example.

FIG. 4C is an overview diagram of a gas-fired liquid heating system 300*g*, according to one example. The system 300*g* is similar to that shown in FIG. 1A with the addition of a fuel source 450 connected to a gas-fired tankless water heater 100*g* and a gas-fired heat source 212*g* by a fuel supply line 500. An advantageous feature of the gas-fired tankless water heater 100*g* is when the gas-fired tankless water heater 100*g* is installed in conjunction with the gas-fired heat source 212*g* of a liquid storage device 200, the fuel supply line 500 to both the gas-fired heat source 212*g* and the gas-fired tankless water heater 100*g* may be shared. The controller 120*g* (not shown as it is disposed inside the gas-fired tankless water heater 100*g*) of the gas-fired tankless water heater 100*g* is generally always supplied electrical power, and will control when to switch between supplying fuel to the gas-fired heat source 212*g* and the gas-fired tankless water heater 100*g*. If the fuel supply infrastructure can support the fuel demand, both the gas-fired tankless water heater 100*g* and the gas-fired heat source 212*g* can fire simultaneously to provide maximum hot water capacity.

FIG. 5 is a process diagram for the tankless electric water heater 100 when connected to the liquid storage device 200, according to one example. The process diagram includes a sequence of primary processes of a water heating system operation method 800 for the tankless electric water heater 100 connected to the liquid storage device 200. The diagram encompasses various operations of the system examples and embodiments described by FIG. 3A through FIG. 2H. The water heating system operation method 800 includes, in this example, an initiating process S10, an operating process S30, a recording process S70, and a communicating process S80.

S10 represents a process of initiating use of a controller 120 of the tankless electric water heater 100, which may include, without limitation, steps related to setting a set point temperature 130, a date and time, a mode of operation, and a type of system (such as if there is a liquid storage device 200, electrically heated or otherwise) and a size of the liquid storage device 200. The steps may be automatic or performed by a user manually via control knob 140 or remotely from an external device such as a mobile device.

In one example, the controller 120 operates with preprogrammed default settings for the set point temperature 130, the date and time, the mode of operation, and the type and the size of the liquid storage device 200 the tankless electric water heater 100 is connected to.

In another example, the user sets or adjusts the set point temperature 130, the date and time, the mode of operation, and the type and the size of the liquid storage device 200 the tankless electric water heater 100 is connected to.

S30 represents a process of the controller 120 operating the tankless electric water heater 100. This can include steps, where applicable and without limitation, related to powering a heating element 128 of the tankless electric water heater 100 and/or the heat source 212 of a liquid storage device 200, detecting or deriving system status such as temperatures at the inlet temperature sensor 104, the outlet temperature sensor 106 or other source, a flow rate from the flow sensor 114, electrical power usage, a date and a time, and a set point temperature 130, routing a flow of water by operating the outlet proportioning valve 116, or controlling the inlet proportioning valve 214 to change the path and source of water leading to the liquid storage device 200, and pumping the recirculation pump 208 to recirculate water from before or after the heating element 128 to the liquid storage device 200.

Operating the tankless electric water heater 100 to distribute electrical power between the tankless electric water heater 100 and the liquid storage device 200, if applicable, to heat water in the most efficient way is a sub-process of S30, as is detecting and deriving system status and other sensor readings, and then adjusting system operation.

In one example, the tankless electric water heater 100 is connected to the liquid storage device 200 and an electrically powered heat source 212. The controller 120 may operate according to the process diagrams described by FIG. 6A and FIG. 6B, where electrical power may be provided to the heating element 128 of the tankless electric water heater 100 and/or the heat source 212 of the liquid storage device 200 to heat water, or in a combination of ways as described with respect to FIG. 4B.

In another example, the tankless electric water heater 100 is connected to the liquid storage device 200 heated by a heat source 212, such as a gas heater that is controlled by a separate liquid storage device controller 198. In this example, the controller 120 controls the tankless electric water heater 100 and can be connected to the device controller 198 to operate the heat source 212 of the liquid storage device 200.

In another example, the tankless electric water heater 100 is connected to an unheated liquid storage device 200, or a liquid storage device 200 heated by a separately controlled heat source 212 such as gas heat, fire, or hot springs, and the controller 120 controls only the tankless electric water heater 100 independently of any controls that may be connected to the liquid storage device 200.

In another example, the controller 120 detects the flow rate of the flow sensor 114 over a period of time and modulates electrical power provided to the heating element 128 to maintain the temperature of the water passing the outlet temperature sensor 106 to be about the same as the set point temperature 130.

In another example, the controller 120 detects the day or date and time and automatically adjusts power to the tankless electric water heater 100 and the heat source 212 of the liquid storage device 200 to increase or decrease the availability of hot water depending on preprogrammed hot water needs at various times. This is useful for conserving power during days and hours where the demand for hot water is low or nonexistent, and for preparing to supply larger quantities of hot water during periods of high demand. The controller 120 may also apply one or more algorithms, for instance a statistical model, to estimate maximum and minimum demand for hot water from the system by day and time, and adjust electrical power use accordingly. In all examples, the controller 120 may generate or use a plurality of set point temperatures 130 to establish upper and lower temperature limits for operations at different times and conditions.

In another example, the controller 120 detects a power outage and switches to operate from a backup power source 132 to continue to maintain the ability to monitor and control some functions of the tankless electric water heater 100, including communication, as described below by primary process S80, to inform external devices or networks of a power outage. Further, if the backup power source 132 possesses sufficient capacity, the tankless electric water heater 100 may be able to continue to operate the heating element 128 and the heat source 212 normally on backup power.

In another example, the controller 120 receives input from the primary process S80 in the form of additional data or direct commands. Such input may be received from devices external to the controller 120, such as other controllers 120 located in the same or nearby structure. Further, external devices may include devices such as smart phones, smart watches, tablets or computers connected to the controller 120 via wired, wireless, or cellular networks.

In another example, the controller 120 maintains water in a liquid storage device 200 at a temperature at or above ambient but relatively low temperature (below about 77 degrees F., for example) so as to help reduce the risk of Legionella developing within the liquid storage device 200. Electrical power is then applied to the heating element 128 to further heat water only as needed.

The following examples relate to recirculation of water through the liquid storage device 200 to reduce the extent of stratification.

In one example, the recirculation pump 208 recirculates water from before or after the heating element 128 of the tankless electric water heater 100 to the liquid storage device 200 to increase the effectiveness of the liquid storage device 200 by reducing stratification. In one case, water is recirculated from a point before the heating element 128 of the tankless electric water heater 100 to the liquid storage device 200. In another case, water is recirculated from a point after the heating element 128 of the tankless electric water heater 100 to the liquid storage device 200, and may be at a higher temperature than that of the water entering the heating element 128. In either case, the inlet proportioning valve 214 may be open or closed. In a case where the inlet proportioning valve 214 is fully closed, only recirculated water enters the liquid storage device 200 from the recirculation pipe 210. In a case where the inlet proportioning valve 214 is partly open, water entering the liquid storage device 200 includes a mixture of recirculated water from the recirculation pipe 210 and non-recirculated water from the second inlet pipe 202.

In another example, the controller 120 controls the outlet proportioning valve 116 to be partly or fully open and the recirculation pump 208 is in operation. In this example, the water flowing out of the liquid storage device 200 through the first inlet pipe 204 is divided between the outlet pipe 206 and the recirculation pipe 210.

Further, additional information may be determined through derivation using available data to aid with operating the tankless electric water heater 100. For example, energy consumption of the heating element 128 can be determined approximately by the controller 120 through a calculation based on the temperatures detected by the inlet temperature sensor 104 and the outlet temperature sensor 106, and the flow rate of water detected by the flow sensor 114.

S70 represents a process of recording specification and historical usage data related to uses of a tankless electric water heater 100, which may include, where applicable and without limitation, size of the liquid storage device 200, power consumption of the tankless electric water heater 100 and the heat source 212, a flow rate as detected by the flow sensor 114 and volume of water consumed, inlet and outlet temperatures as measured by the inlet temperature sensor 104 and the outlet temperature sensor 106, respectively, a set point temperature 130, room or ambient temperature, and duration of use, including the day or date and time period of use.

S80 represents a process of the controller 120 communicating a status of use or recorded data (see S70) of a tankless electric water heater 100 to external networks or devices and receiving information external to the tankless electric water heater 100, which may include, where applicable and without limitation, steps related to those of S30.

These steps may include using information external to the controller 120 to better optimize usage of the tankless electric water heater 100. This information can be received wirelessly by the controller 120 through a home network as would be understood by one of ordinary skill in the art. Factors may include times when area-wide demand (for a neighborhood or a city, for example) or pricing of electrical power is at a peak or trough, comparing usage patterns of the tankless electric water heater 100 with those of other tankless electric water heater 100 for efficiency or diagnostic purposes, and adjusting operation of the tankless electric water heater 100 so as to better balance resource usage across a power grid or a water supply more readily. Such information may include aggregate data of other devices, such as neighboring tankless electric water heaters 100, visible to the power grid or water utility but not to the controller 120 of the particular tankless electric water heater 100.

In one example, a remote network may reduce or disable power to or turn off the tankless electric water heater 100 for a period of time in order to conserve power for the power grid.

In another example, a remote network may query the controller 120 for diagnostic purposes such as determining if electrical power is available to the tankless electric water heater 100, or diagnosing the condition of the controller 120 and tankless electric water heater 100.

In another example, the remote network may set or change particular settings of the tankless electric water heater 100, such as those related to the set point temperature 130, operation of the switching mechanism 108, the high speed switch 112, the outlet proportioning valve 116, the heating element 128, the backup power source 132, the recirculation pump 208, the liquid storage device controller 198, and the inlet proportioning valve 214.

Figure 6A:
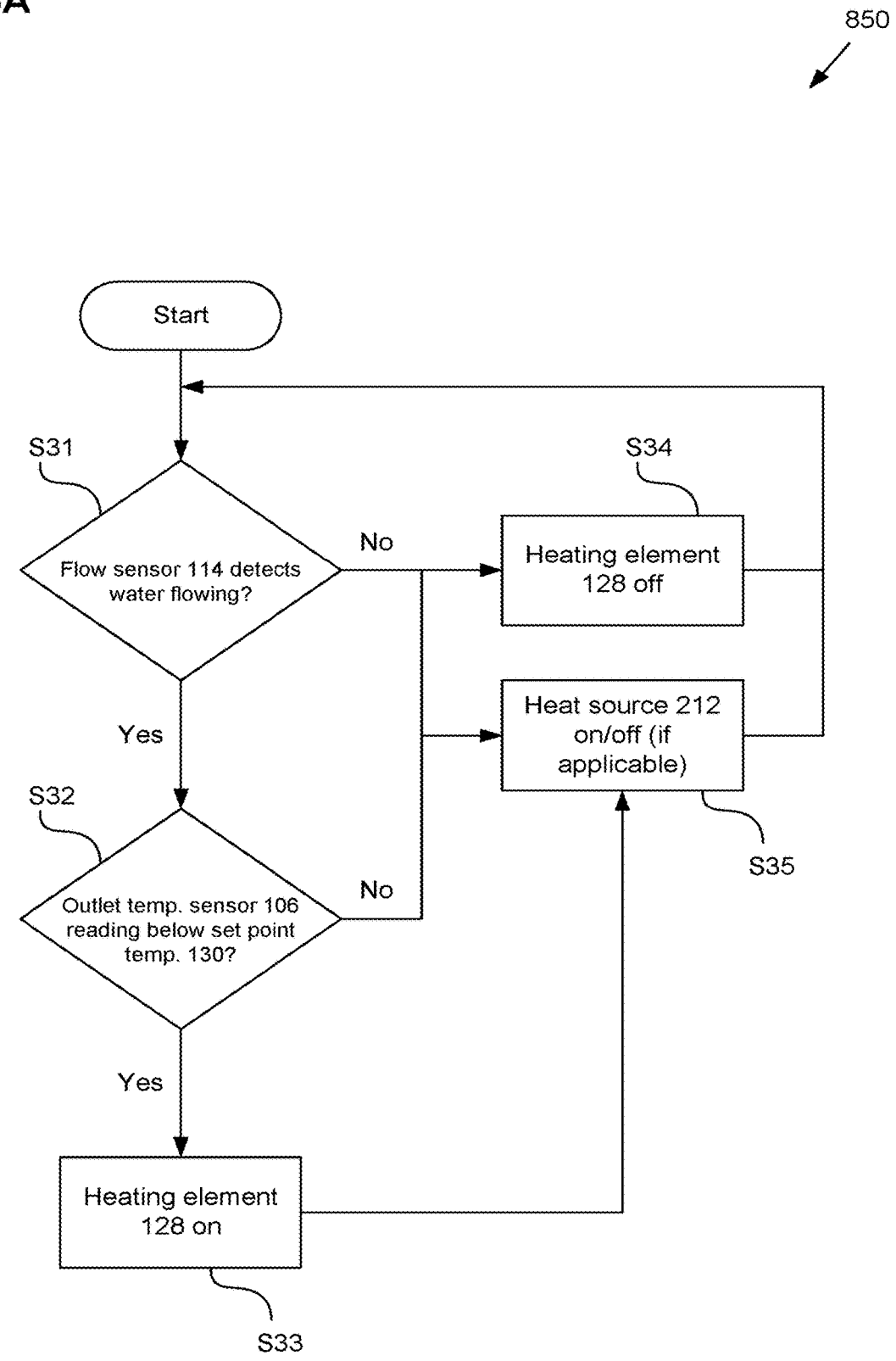
FIG. 6A is a flow chart depicting a first water heating process of a controller, according to one example.

FIG. 6A is a flow chart depicting a first water heating process 850 of the controller 120, according to one example. At step S31, the controller 120 reading measurements from the flow sensor 114 of the flow rate of water coming into the inlet fitting 124 to determine whether water is flowing into the tankless electric water heater 100. If the controller 120 determines that water is not flowing into the tankless electric water heater 100, the controller 120 controls the heating element 128 to deactivate if the heating element 128 isn't already deactivated at step S34. If the controller 120 does detect the flow of water at step S31, the controller 120 reads measurements from the outlet temperature sensor 106 to determine if water exiting the heating chamber is below the set point temperature 130 at step S32. If the controller 120 determines that water is not below the set point temperature 130 at step S32, the controller deactivates at step S34 the heating element 128 if the heating element isn't already deactivated. If the tankless electric water heater 100 is connected to another heat source 212, the controller 120 can also control this heat source 212 to be deactivated at step S35. At this point, the process 850 then returns to step S31. If, however, the controller 120 determines that the temperature is below the set point temperature 130 at step S32, the controller 128 provides power to the heating element 128 at step S33, and optionally to the heat source 212, if applicable, at step S35. At this point, the process 850 then repeats by returning to step S31.

Figure 6B:
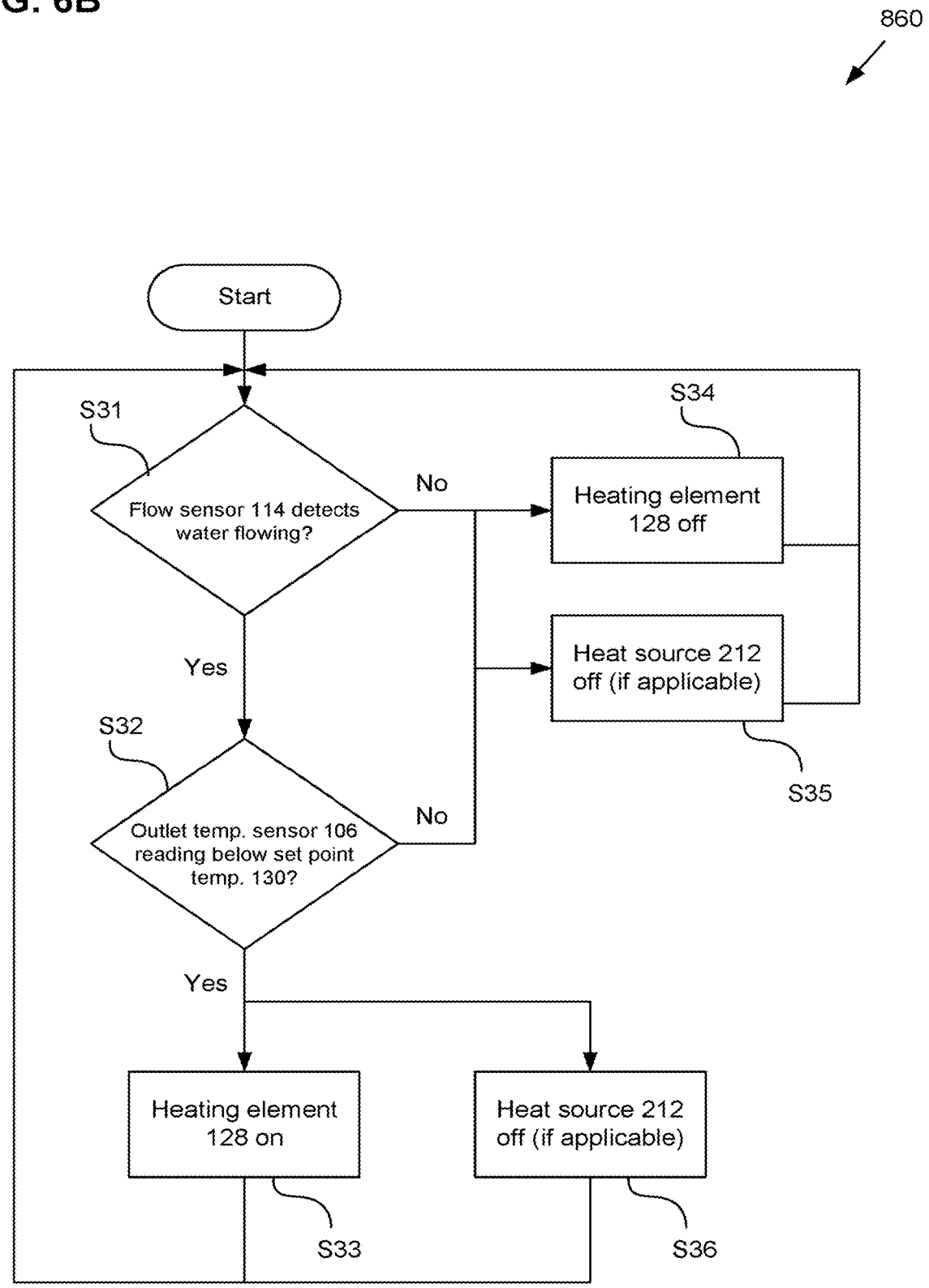
FIG. 6B is a flow chart depicting a second water heating process of the controller, according to one example.

FIG. 6B is a flow chart depicting a second water heating process 860 of the controller 120, according to one example. At step S31, the controller 120 reading measurements from the flow sensor 114 of the flow rate of water coming into the inlet fitting 124 to determine whether water is flowing into the tankless electric water heater 100. If the controller 120 determines that water is not flowing into the tankless electric water heater 100, the controller 120 controls the heating element 128 to deactivate if the heating element 128 isn't already deactivated at step S34. If the controller 120 does detect the flow of water at step S31, the controller 120 reads measurements from the outlet temperature sensor 106 to determine if water exiting the heating chamber is below the set point temperature 130 at step S32. If the controller 120 determines that water is not below the set point temperature 130 at step S32, the controller deactivates at step S34 the heating element 128 if the heating element isn't already deactivated. If the tankless electric water heater 100 is connected to another heat source 212, the controller 120 can also control this heat source 212 to be deactivated at step S35. At this point, the process 860 then returns to step S31. If, however, the controller 120 determines that the temperature is below the set point temperature 130 at step S32, the controller 128 provides power to the heating element 128 at step S33, and optionally deactivates the heat source 212, if applicable, at step S36. At this point, the process 860 then repeats by returning to step S31.

Figure 7:
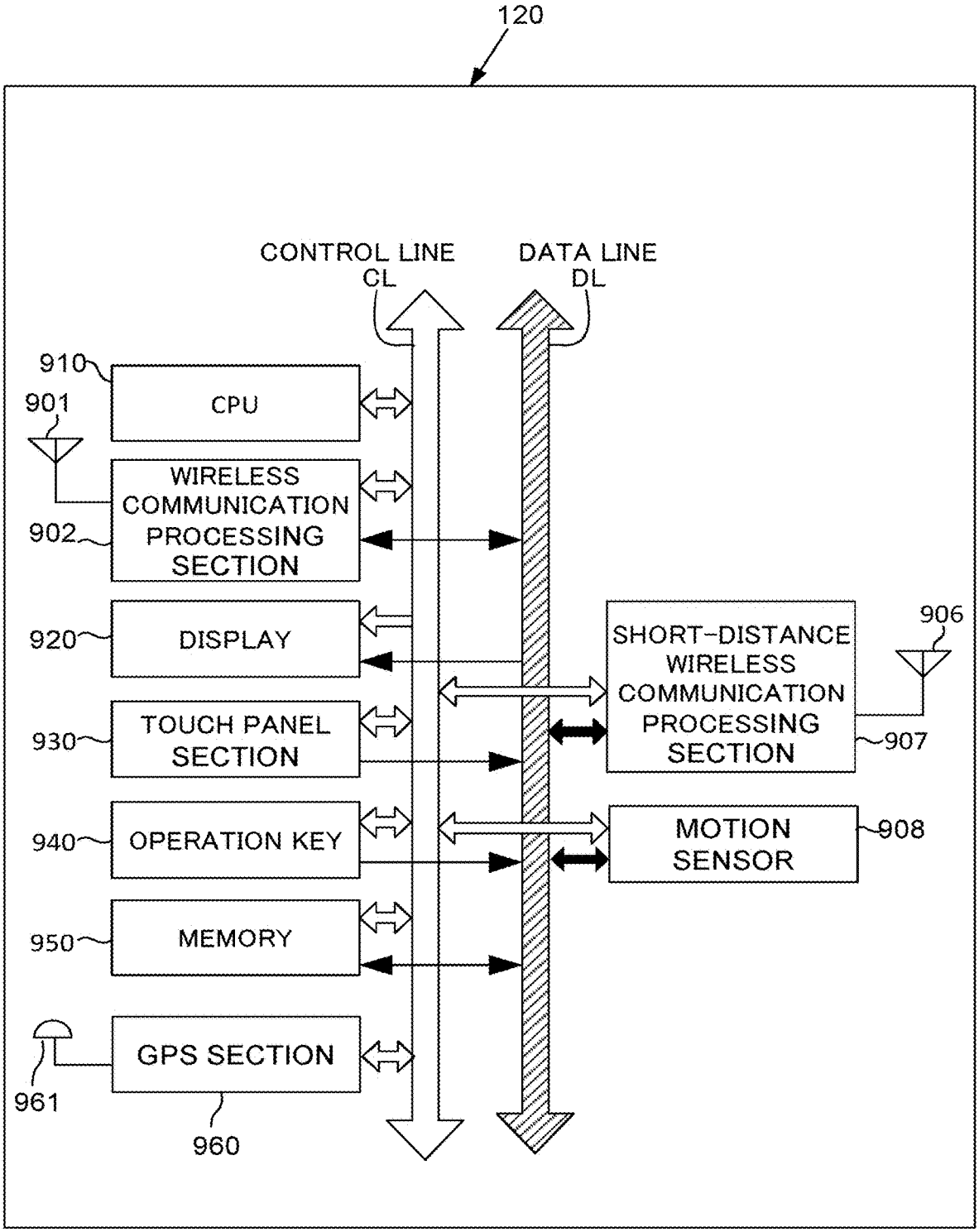
FIG. 7 is a block diagram illustrating the controller, according to one example.

FIG. 7 is a block diagram illustrating the controller 120 for implementing the functionality of the tankless electric water heater 100 described herein, according to one example. The skilled artisan will appreciate that the features described herein may be adapted to be implemented on a variety of devices (e.g., a laptop, a tablet, a server, an e-reader, navigation device, etc.). The controller 120 includes a Central Processing Unit (CPU) 910 and a wireless communication processor 902 connected to an antenna 901.

The CPU 910 may include one or more CPUs 910, and may control each element in the controller 120 to perform functions related to communication control and other kinds of signal processing. The CPU 910 may perform these functions by executing instructions stored in a memory 950. Alternatively or in addition to the local storage of the memory 950, the functions may be executed using instructions stored on an external device accessed on a network or on a non-transitory computer readable medium.

The memory 950 includes but is not limited to Read Only Memory (ROM), Random Access Memory (RAM), or a memory array including a combination of volatile and non-volatile memory units. The memory 950 may be utilized as working memory by the CPU 910 while executing the processes and algorithms of the present disclosure. Additionally, the memory 950 may be used for long-term data storage. The memory 950 may be configured to store information and lists of commands.

The controller 120 includes a control line CL and data line DL as internal communication bus lines. Control data to/from the CPU 910 may be transmitted through the control line CL. The data line DL may be used for transmission of data.

The antenna 901 transmits/receives electromagnetic wave signals between base stations for performing radio-based communication, such as the various forms of cellular telephone communication. The wireless communication processor 902 controls the communication performed between the controller 120 and other external devices via the antenna 901. For example, the wireless communication processor 902 may control communication between base stations for cellular phone communication.

The controller 120 may also include the display 920, a touch panel 930, an operation key 940, and a short-distance communication processor 907 connected to an antenna 906. The display 920 may be a Liquid Crystal Display (LCD), an organic electroluminescence display panel, or another display screen technology. In addition to displaying still and moving image data, the display 920 may display operational inputs, such as numbers or icons which may be used for control of the controller 120. The display 920 may additionally display a GUI for a user to control aspects of the controller 120 and/or other devices. Further, the display 920 may display characters and images received by the controller 120 and/or stored in the memory 950 or accessed from an external device on a network. For example, the controller 120 may access a network such as the Internet and display text and/or images transmitted from a Web server.

The touch panel 930 may include a physical touch panel display screen and a touch panel driver. The touch panel 930 may include one or more touch sensors for detecting an input operation on an operation surface of the touch panel display screen. The touch panel 930 also detects a touch shape and a touch area. Used herein, the phrase "touch operation" refers to an input operation performed by touching an operation surface of the touch panel display with an instruction object, such as a finger, thumb, or stylus-type instrument. In the case where a stylus or the like is used in a touch operation, the stylus may include a conductive material at least at the tip of the stylus such that the sensors included in the touch panel 930 may detect when the stylus approaches/contacts the operation surface of the touch panel display (similar to the case in which a finger is used for the touch operation).

In certain aspects of the present disclosure, the touch panel 930 may be disposed adjacent to the display 920 (e.g., laminated) or may be formed integrally with the display 920. For simplicity, the present disclosure assumes the touch panel 930 is formed integrally with the display 920 and therefore, examples discussed herein may describe touch operations being performed on the surface of the display 920 rather than the touch panel 930. However, the skilled artisan will appreciate that this is not limiting.

For simplicity, the present disclosure assumes the touch panel 930 is a capacitance-type touch panel technology. However, it should be appreciated that aspects of the present disclosure may easily be applied to other touch panel types (e.g., resistance-type touch panels) with alternate structures. In certain aspects of the present disclosure, the touch panel 930 may include transparent electrode touch sensors arranged in the X-Y direction on the surface of transparent sensor glass.

The operation key 940 may include one or more buttons or similar external control elements, which may generate an operation signal based on a detected input by the user. In addition to outputs from the touch panel 930, these operation signals may be supplied to the CPU 910 for performing related processing and control. In certain aspects of the present disclosure, the processing and/or functions associated with external buttons and the like may be performed by the CPU 910 in response to an input operation on the touch panel 930 display screen rather than the external button, key, etc. In this way, external buttons on the controller 120 may be eliminated in lieu of performing inputs via touch operations, thereby improving water-tightness.

The antenna 906 may transmit/receive electromagnetic wave signals to/from other external apparatuses, and the short-distance wireless communication processor 907 may control the wireless communication performed between the other external apparatuses. Bluetooth, IEEE 802.11, and near-field communication (NFC) are non-limiting examples of wireless communication protocols that may be used for inter-device communication via the short-distance wireless communication processor 907.

The controller 120 may include a motion sensor 908. The motion sensor 908 may detect features of motion (i.e., one or more movements) of the controller 120. For example, the motion sensor 908 may include an accelerometer to detect acceleration, a gyroscope to detect angular velocity, a geo-magnetic sensor to detect direction, a geo-location sensor to detect location, etc., or a combination thereof to detect motion of the controller 120. In certain embodiments, the motion sensor 908 may generate a detection signal that includes data representing the detected motion. For example, the motion sensor 908 may determine a number of distinct movements in a motion (e.g., from start of the series of movements to the stop, within a predetermined time interval, etc.), a number of physical shocks on the controller 120 (e.g., a jarring, hitting, etc., of the electronic device), a speed and/or acceleration of the motion (instantaneous and/or temporal), or other motion features. The detected motion features may be included in the generated detection signal. The detection signal may be transmitted, e.g., to the CPU 910, whereby further processing may be performed based on data included in the detection signal. The motion sensor 908 can work in conjunction with a Global Positioning System (GPS) section 960. The GPS section 960 detects the present position of the controller 120. The information of the present position detected by the GPS section 960 is transmitted to the CPU 910. An antenna 961 is connected to the GPS section 960 for receiving and transmitting signals to and from a GPS satellite.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernable variants of the teachings herein, define, in part, the scope of the foregoing claim terminology such that no inventive subject matter is dedicated to the public.

The above disclosure also encompasses the embodiments listed below.

(1) A fluid heating device including: an inlet, an outlet, a heating chamber disposed between the inlet port and the outlet port, a heating element disposed inside the heating chamber, a flow sensor configured to detect a flow of liquid downstream of the inlet, a first temperature sensor configured to detect a first temperature of the fluid between the heating chamber and the outlet, and a controller configured to regulate a power supply to the heating element as a function of the first temperature.

(2) The fluid heating device of (1), further including a conduit connecting the inlet to the heating chamber, wherein a flow path exists from the inlet to the heating chamber via the first conduit and out of the fluid heating device via the outlet.

(3) The fluid heating device of (1) or (2), further including a valve upstream of the outlet and downstream of the first temperature sensor, wherein the controller controls the valve as a function of at least one of the first temperature and flow rate.

(4) The fluid heating device of any one of (1) to (3), wherein the controller is configured to close the valve to prohibit flow of the liquid until the first temperature is at a predetermined value.

(5) The fluid heating device of any one of (1) to (4), wherein the heating chamber includes a first, second and third heating chamber conduit, the first and second heating chamber conduits are configured to provide an inlet to the heating chamber and are connected via the third heating chamber conduit, and the third heating chamber conduit is connected to the first conduit and configured to receive fluid from the inlet.

(6) The fluid heating device of any one of (1) to (5), wherein the heating chamber further includes a fourth heating chamber conduit configured to provide a flow path to the outlet for fluid within heating chamber.

(7) The fluid heating device of any one of (1) to (6), wherein a flow path exists from the inlet to the outlet via the first, second, third and fourth heating chamber conduits.

(8) The fluid heating device of any one of (1) to (7), further including a second temperature sensor configured to detect a second temperature of fluid downstream of the inlet port.

(9) The fluid heating device of any one of (1) to (8), wherein the controller is further configured to regulate the power supply to the heating element as a function the second temperature.

(10) The fluid heating device of any one of (1) to (9), wherein the second temperature sensor is disposed between the inlet and the flow sensor.

(11) The fluid heating device of any one of (1) to (10), wherein the flow sensor is disposed between the conduit and the second temperature sensor.

(12) The fluid heating device of any one of (1) to (11), further including a valve upstream of the outlet and downstream of the first temperature sensor, wherein the controller controls the valve as a function of the first temperature, and the second temperature.

(13) The fluid heating device of any one of (1) to (12), further including a housing to house the heating chamber, the first temperature sensor and the flow sensor.

(14) The fluid heating device of any one of (1) to (13), further including a display screen to display settings of the fluid heating device, and an input to adjust the settings of the fluid heating device.

(15) The fluid heating device of any one of (1) to (14), wherein the controller is configured to regulate a power supply to the heating element as a function of the flow.

(16) A system including a liquid storage device, an inlet pipe connected to an outlet of the liquid storage device, and a fluid heating device having an inlet connected to the inlet pipe, an outlet, a heating chamber disposed between the inlet and the outlet, a heating element disposed inside the heating chamber, a flow sensor configured to detect a flow of liquid downstream of the inlet, a conduit connecting the inlet and the heating chamber, a first temperature sensor configured to detect a first temperature of the fluid between the heating chamber and the outlet, a controller configured to regulate a supply of power to the heating element as a function the first temperature.

(17) The system according to claim 16, wherein the liquid storage device includes a first power supply, and a liquid storage device heating element, and the fluid heating device further includes a second power supply, and a switch connected to the first power supply and the second power supply, wherein the controller is configured to control the switch to switch between providing a supply of power to the liquid storage device heating element via the first power supply or providing a supply of power to the heating element via the second power supply.

(18) The system according to (16) or (17), further including a second inlet pipe connected to the liquid storage device, a recirculation pipe connected to the fluid heating device and the second inlet pipe, and a recirculation pump, wherein the controller is configured to control the recirculation pump to recirculate fluid from the fluid heating device to the liquid storage device via the recirculation pipe.

(19) The system according to any one of (16) to (18), wherein the recirculation pipe is connected to the fluid heating device upstream of the heating element.

(20) The system according to any one of (16) to (19), wherein the recirculation pipe is connected to the fluid heating device downstream of the heating element.

(21) The system according to any one of (16) to (20), further including an inlet proportioning valve connected to the second inlet pipe, wherein controller is configured to control the inlet proportioning valve to control fluid temperature and flow.

What is claimed is:

1. A system comprising:

a liquid storage device, the liquid storage device comprising a liquid storage device power supply and a liquid storage device heating element;

an inlet pipe connected to an outlet of the liquid storage device; and a fluid heating device comprising:

a fluid heating device power supply;

an inlet;

an outlet;

a heating chamber disposed between the inlet and the outlet;

a fluid heating device heating element disposed inside the heating chamber;

a flow sensor configured to detect a flow rate of fluid downstream of the inlet;

a valve; and a first temperature sensor configured to detect a first temperature of the fluid downstream of the inlet; and a controller configured to control a switch to switch between providing a supply of power to the liquid storage device heating element via the liquid storage device power supply or providing a supply of power to the fluid heating device heating element via the fluid heating device power supply.

2. The system of claim 1, further comprising:

a second temperature sensor configured to detect a second temperature of the fluid exiting the heating chamber, wherein the controller is further configured to control the valve as a function of the second temperature.

3. The system of claim 2, wherein the controller is configured to adjust the valve to limit flow of the liquid until the second temperature is at the set point temperature.

4. The system of claim 1, further comprising:

a conduit connecting the inlet to the heating chamber, wherein a flow path exists from the inlet to the heating chamber via the first conduit and out of the fluid heating device via the outlet.

5. The system of claim 2, wherein the second temperature sensor is disposed between the heating chamber and the outlet.

6. The system of claim 2, wherein the controller is configured to close the valve if the second temperature exceeds a predetermined safety temperature.

7. The system of claim 2, wherein the controller is further configured to incrementally close the valve when the second temperature is less than the set point temperature until the second temperature meets the set point temperature or a minimum valve position is reached.

8. The system of claim 1, wherein the first temperature sensor is disposed between the inlet and an inlet to the heating chamber.

9. The system of claim 1, wherein the flow sensor is disposed between the inlet and an inlet to the heating chamber.

10. The system of claim 2, wherein the controller is configured to proportionally reduce the amount at which the valve is open until the second temperature reaches the set point temperature.

11. The system of claim 1, wherein the valve is disposed between the heating chamber and the outlet.

12. The system of claim 1, further comprising:

an input device including a display screen configured to display settings of the fluid heating device and receive input of the set point temperature.

13. The system of claim 2, wherein the second temperature sensor is downstream of the outlet.

14. The system according to claim 2, wherein the valve is incrementally opened when the second temperature is greater than or equal to the set point temperature and continues to open as long as the second temperature meets the set point temperature or until a maximum valve position is reached.

15. A system comprising:

a liquid storage device, the liquid storage device comprising a liquid storage device power supply and a liquid storage device heating element;

an inlet pipe connected to an outlet of the liquid storage device;

a fluid heating device having a fluid heating device power supply;

an inlet connected to the inlet pipe;

an outlet;

a heating chamber disposed between the inlet and the outlet;

a fluid heating device heating element disposed inside the heating chamber;

a valve;

a flow sensor configured to detect a flow rate of fluid downstream of the inlet; and a first temperature sensor configured to detect a first temperature of the fluid downstream of the inlet;

a switch connected to the fluid heating device power supply and the liquid storage device power supply; and a controller configured to receive a set point temperature;

maintain the fluid at the set point temperature by adjusting an amount at which the valve is opened as a function of the first temperature, the flow rate, and an available power of the fluid heating device power supply; and control the switch to switch between providing a supply of power to the liquid storage device heating element via the liquid storage device power supply or providing a supply of power to the fluid heating device heating element via the fluid heating device power supply.

16. The system according to claim 15, further comprising:

a second inlet pipe connected to the liquid storage device;

a recirculation pipe connected to the fluid heating device and the second inlet pipe; and a recirculation pump, wherein the controller is configured to control the recirculation pump to recirculate fluid from the fluid heating device to the liquid storage device via the recirculation pipe.

17. The system according to claim 16, wherein the recirculation pipe is connected to the fluid heating device upstream of the fluid heating device heating element.

18. The system according to claim 16, wherein the recirculation pipe is connected to the fluid heating device downstream of the fluid heating device heating element.

19. The system according to claim 16, further comprising:

an inlet proportioning valve connected to the second inlet pipe, wherein controller is configured to control the inlet proportioning valve to control fluid temperature and flow.

* * * * *